US009595378B2

(12) United States Patent
Jonas et al.

(10) Patent No.: US 9,595,378 B2
(45) Date of Patent: Mar. 14, 2017

(54) RESONATOR ENCLOSURE

(71) Applicant: WiTricity Corporation, Watertown, MA (US)

(72) Inventors: Jude R. Jonas, Hudson, NH (US); Matthew J. MacDonald, Boxford, MA (US); Morris P. Kesler, Bedford, MA (US); Andre B. Kurs, Chestnut Hill, MA (US); Jonathan Sirota, Sudbury, MA (US); Konrad J. Kulikowski, Denver, CO (US); Hamik Amirkhani, Watertown, MA (US)

(73) Assignee: WiTricity Corporation, Watertown, MA (US)

( * ) Notice: Subject to any disclaimer, the term of this patent is extended or adjusted under 35 U.S.C. 154(b) by 548 days.

(21) Appl. No.: 14/031,737

(22) Filed: Sep. 19, 2013

(65) Prior Publication Data

US 2014/0175892 A1 Jun. 26, 2014

Related U.S. Application Data

(60) Provisional application No. 61/703,127, filed on Sep. 19, 2012.

(51) Int. Cl.

| | |
|---|---|
| ***H01F 27/02*** | (2006.01) |
| ***H01F 38/14*** | (2006.01) |
| ***H01F 27/00*** | (2006.01) |

(52) U.S. Cl.

CPC ..... *H01F 27/02* (2013.01); *H01F 27/006* (2013.01); *H01F 38/14* (2013.01)

(58) Field of Classification Search

CPC ..... H01F 27/02; H01F 27/006; H01F 38/14

(Continued)

(56) References Cited

U.S. PATENT DOCUMENTS

| | | | |
|---|---|---|---|
| 645,576 | A | 3/1900 | Telsa |
| 649,621 | A | 5/1900 | Tesla |

(Continued)

FOREIGN PATENT DOCUMENTS

| | | |
|---|---|---|
| CA | 142352 | 8/1912 |
| CN | 102239633 | 11/2011 |

(Continued)

OTHER PUBLICATIONS

"Next Little Thing 2010 Electricity without wires", CNN Money (See money.cnn.com/galleries/2009/smallbusiness/0911/gallery.next_little_thing_2010.smb/) (dated Nov. 30, 2009).

(Continued)

*Primary Examiner* — Jared Fureman
*Assistant Examiner* — Emmanuel R Dominique
(74) *Attorney, Agent, or Firm* — Fish & Richardson P.C.

(57) ABSTRACT

Described herein are improved configurations for a wireless power transfer and mechanical enclosures. The described structure holds and secures the components of a resonator while providing adequate structural integrity, thermal control, and protection against environmental elements. The coil enclosure structure comprises a flat, planar material with a recess for an electrical conductor wrapped around blocks of magnetic material as well as an additional planar material to act as a cover for the recess.

20 Claims, 8 Drawing Sheets

(58) Field of Classification Search
USPC ..... 307/104
See application file for complete search history.

(56) References Cited

U.S. PATENT DOCUMENTS

| | | | |
|---|---|---|---|
| 787,412 | A | 4/1905 | Tesla |
| 1,119,732 | A | 12/1914 | Tesla |
| 2,133,494 | A | 10/1938 | Waters |
| 3,517,350 | A | 6/1970 | Beaver |
| 3,535,543 | A | 10/1970 | Dailey |
| 3,780,425 | A | 12/1973 | Penn et al. |
| 3,871,176 | A | 3/1975 | Schukei |
| 4,088,999 | A | 5/1978 | Fletcher et al. |
| 4,095,998 | A | 6/1978 | Hanson |
| 4,180,795 | A | 12/1979 | Matsuda et al. |
| 4,280,129 | A | 7/1981 | Wells |
| 4,450,431 | A | 5/1984 | Hochstein |
| 4,588,978 | A | 5/1986 | Allen |
| 5,027,709 | A | 7/1991 | Slagle |
| 5,033,295 | A | 7/1991 | Schmid et al. |
| 5,034,658 | A | 7/1991 | Hiering et al. |
| 5,053,774 | A | 10/1991 | Schuermann et al. |
| 5,070,293 | A | 12/1991 | Ishii et al. |
| 5,118,997 | A | 6/1992 | El-Hamamsy |
| 5,216,402 | A | 6/1993 | Carosa |
| 5,229,652 | A | 7/1993 | Hough |
| 5,287,112 | A | 2/1994 | Schuermann |
| 5,341,083 | A | 8/1994 | Klontz et al. |
| 5,367,242 | A | 11/1994 | Hulman |
| 5,374,930 | A | 12/1994 | Schuermann |
| 5,408,209 | A | 4/1995 | Tanzer et al. |
| 5,437,057 | A | 7/1995 | Richley et al. |
| 5,455,467 | A | 10/1995 | Young et al. |
| 5,493,691 | A | 2/1996 | Barrett |
| 5,522,856 | A | 6/1996 | Reineman |
| 5,528,113 | A | 6/1996 | Boys et al. |
| 5,541,604 | A | 7/1996 | Meier |
| 5,550,452 | A | 8/1996 | Shirai et al. |
| 5,565,763 | A | 10/1996 | Arrendale et al. |
| 5,630,835 | A | 5/1997 | Brownlee |
| 5,697,956 | A | 12/1997 | Bornzin |
| 5,703,461 | A | 12/1997 | Minoshima et al. |
| 5,703,573 | A | 12/1997 | Fujimoto et al. |
| 5,710,413 | A | 1/1998 | King et al. |
| 5,742,471 | A | 4/1998 | Barbee, Jr. et al. |
| 5,821,728 | A | 10/1998 | Schwind |
| 5,821,731 | A | 10/1998 | Kuki et al. |
| 5,864,323 | A | 1/1999 | Berthon |
| 5,898,579 | A | 4/1999 | Boys et al. |
| 5,903,134 | A | 5/1999 | Takeuchi |
| 5,923,544 | A | 7/1999 | Urano |
| 5,940,509 | A | 8/1999 | Jovanovich et al. |
| 5,957,956 | A | 9/1999 | Kroll et al. |
| 5,959,245 | A | 9/1999 | Moe et al. |
| 5,986,895 | A | 11/1999 | Stewart et al. |
| 5,993,996 | A | 11/1999 | Firsich |
| 5,999,308 | A | 12/1999 | Nelson et al. |
| 6,012,659 | A | 1/2000 | Nakazawa et al. |
| 6,047,214 | A | 4/2000 | Mueller et al. |
| 6,066,163 | A | 5/2000 | John |
| 6,067,473 | A | 5/2000 | Greeninger et al. |
| 6,108,579 | A | 8/2000 | Snell et al. |
| 6,127,799 | A | 10/2000 | Krishnan |
| 6,176,433 | B1 | 1/2001 | Uesaka et al. |
| 6,184,651 | B1 | 2/2001 | Fernandez et al. |
| 6,207,887 | B1 | 3/2001 | Bass et al. |
| 6,232,841 | B1 | 5/2001 | Bartlett et al. |
| 6,238,387 | B1 | 5/2001 | Miller, III |
| 6,252,762 | B1 | 6/2001 | Amatucci |
| 6,436,299 | B1 | 8/2002 | Baarman et al. |
| 6,450,946 | B1 | 9/2002 | Forsell |
| 6,452,465 | B1 | 9/2002 | Brown et al. |
| 6,459,218 | B2 | 10/2002 | Boys et al. |
| 6,473,028 | B1 | 10/2002 | Luc |
| 6,483,202 | B1 | 11/2002 | Boys |
| 6,515,878 | B1 | 2/2003 | Meins et al. |
| 6,535,133 | B2 | 3/2003 | Gohara |
| 6,561,975 | B1 | 5/2003 | Pool et al. |
| 6,563,425 | B2 | 5/2003 | Nicholson et al. |
| 6,597,076 | B2 | 7/2003 | Scheible et al. |
| 6,609,023 | B1 | 8/2003 | Fischell et al. |
| 6,631,072 | B1 | 10/2003 | Paul et al. |
| 6,650,227 | B1 | 11/2003 | Bradin |
| 6,664,770 | B1 | 12/2003 | Bartels |
| 6,673,250 | B2 | 1/2004 | Kuennen et al. |
| 6,683,256 | B2 | 1/2004 | Kao |
| 6,696,647 | B2 | 2/2004 | Ono et al. |
| 6,703,921 | B1 | 3/2004 | Wuidart et al. |
| 6,731,071 | B2 | 5/2004 | Baarman |
| 6,749,119 | B2 | 6/2004 | Scheible et al. |
| 6,772,011 | B2 | 8/2004 | Dolgin |
| 6,798,716 | B1 | 9/2004 | Charych |
| 6,803,744 | B1 | 10/2004 | Sabo |
| 6,806,649 | B2 | 10/2004 | Mollema et al. |
| 6,812,645 | B2 | 11/2004 | Baarman |
| 6,825,620 | B2 | 11/2004 | Kuennen et al. |
| 6,831,417 | B2 | 12/2004 | Baarman |
| 6,839,035 | B1 | 1/2005 | Addonisio et al. |
| 6,844,702 | B2 | 1/2005 | Giannopoulos et al. |
| 6,856,291 | B2 | 2/2005 | Mickle et al. |
| 6,858,970 | B2 | 2/2005 | Malkin et al. |
| 6,906,495 | B2 | 6/2005 | Cheng et al. |
| 6,917,163 | B2 | 7/2005 | Baarman |
| 6,917,431 | B2 | 7/2005 | Soljacic et al. |
| 6,937,130 | B2 | 8/2005 | Scheible et al. |
| 6,960,968 | B2 | 11/2005 | Odendaal et al. |
| 6,961,619 | B2 | 11/2005 | Casey |
| 6,967,462 | B1 | 11/2005 | Landis |
| 6,975,198 | B2 | 12/2005 | Baarman et al. |
| 6,988,026 | B2 | 1/2006 | Breed et al. |
| 7,027,311 | B2 | 4/2006 | Vanderelli et al. |
| 7,035,076 | B1 | 4/2006 | Stevenson |
| 7,042,196 | B2 | 5/2006 | Ka-Lai et al. |
| 7,069,064 | B2 | 6/2006 | Gevorgian et al. |
| 7,084,605 | B2 | 8/2006 | Mickle et al. |
| 7,116,200 | B2 | 10/2006 | Baarman et al. |
| 7,118,240 | B2 | 10/2006 | Baarman et al. |
| 7,126,450 | B2 | 10/2006 | Baarman et al. |
| 7,127,293 | B2 | 10/2006 | MacDonald |
| 7,132,918 | B2 | 11/2006 | Baarman et al. |
| 7,147,604 | B1 | 12/2006 | Allen et al. |
| 7,180,248 | B2 | 2/2007 | Kuennen et al. |
| 7,191,007 | B2 | 3/2007 | Desai et al. |
| 7,193,418 | B2 | 3/2007 | Freytag |
| D541,322 | S | 4/2007 | Garrett et al. |
| 7,212,414 | B2 | 5/2007 | Baarman |
| 7,233,137 | B2 | 6/2007 | Nakamura et al. |
| D545,855 | S | 7/2007 | Garrett et al. |
| 7,239,110 | B2 | 7/2007 | Cheng et al. |
| 7,248,017 | B2 | 7/2007 | Cheng et al. |
| 7,251,527 | B2 | 7/2007 | Lyden |
| 7,288,918 | B2 | 10/2007 | DiStefano |
| 7,340,304 | B2 | 3/2008 | MacDonald |
| 7,375,492 | B2 | 5/2008 | Calhoon et al. |
| 7,375,493 | B2 | 5/2008 | Calhoon et al. |
| 7,378,817 | B2 | 5/2008 | Calhoon et al. |
| 7,382,636 | B2 | 6/2008 | Baarman et al. |
| 7,385,357 | B2 | 6/2008 | Kuennen et al. |
| 7,443,135 | B2 | 10/2008 | Cho |
| 7,462,951 | B1 | 12/2008 | Baarman |
| 7,466,213 | B2 | 12/2008 | Löbl et al. |
| 7,471,062 | B2 | 12/2008 | Bruning |
| 7,474,058 | B2 | 1/2009 | Baarman |
| 7,492,247 | B2 | 2/2009 | Schmidt et al. |
| 7,514,818 | B2 | 4/2009 | Abe et al. |
| 7,518,267 | B2 | 4/2009 | Baarman |
| 7,521,890 | B2 | 4/2009 | Lee et al. |
| 7,525,283 | B2 | 4/2009 | Cheng et al. |
| 7,545,337 | B2 | 6/2009 | Guenther |
| 7,554,316 | B2 | 6/2009 | Stevens et al. |
| 7,599,743 | B2 | 10/2009 | Hassler, Jr. et al. |
| 7,615,936 | B2 | 11/2009 | Baarman et al. |
| 7,639,514 | B2 | 12/2009 | Baarman |
| 7,741,734 | B2 | 6/2010 | Joannopoulos et al. |

(56) References Cited

U.S. PATENT DOCUMENTS 7,795,708 B2 9/2010 Katti
7,825,543 B2 11/2010 Karalis et al.
7,825,544 B2 11/2010 Jansen et al.
7,835,417 B2 11/2010 Heideman et al.
7,843,288 B2 11/2010 Lee et al.
7,844,306 B2 11/2010 Shearer et al.
7,863,859 B2 1/2011 Soar
7,880,337 B2 2/2011 Farkas
7,884,697 B2 2/2011 Wei et al.
7,885,050 B2 2/2011 Lee
7,919,886 B2 4/2011 Tanaka
7,923,870 B2 4/2011 Jin
7,932,798 B2 4/2011 Tolle et al.
7,948,209 B2 5/2011 Jung
7,952,322 B2 5/2011 Partovi et al.
7,963,941 B2 6/2011 Wilk
7,969,045 B2 6/2011 Schmidt et al.
7,994,880 B2 8/2011 Chen et al.
7,999,506 B1 8/2011 Hollar et al.
8,022,576 B2 9/2011 Joannopoulos et al.
8,035,255 B2 10/2011 Kurs et al.
8,076,800 B2 12/2011 Joannopoulos et al.
8,076,801 B2 12/2011 Karalis et al.
8,084,889 B2 12/2011 Joannopoulos et al.
8,097,983 B2 1/2012 Karalis et al.
8,106,539 B2 1/2012 Schatz et al.
8,115,448 B2 2/2012 John
8,131,378 B2 3/2012 Greenberg et al.
8,178,995 B2 5/2012 Amano et al.
8,193,769 B2 6/2012 Azancot et al.
8,212,414 B2 7/2012 Howard et al.
8,260,200 B2 9/2012 Shimizu et al.
8,304,935 B2 11/2012 Karalis et al.
8,324,759 B2 12/2012 Karalis et al.
8,334,620 B2 12/2012 Park et al.
8,362,651 B2 1/2013 Hamam et al.
8,395,282 B2 3/2013 Joannopoulos et al.
8,395,283 B2 3/2013 Joannopoulos et al.
8,400,017 B2 3/2013 Kurs et al.
8,400,018 B2 3/2013 Joannopoulos et al.
8,400,019 B2 3/2013 Joannopoulos et al.
8,400,020 B2 3/2013 Joannopoulos et al.
8,400,021 B2 3/2013 Joannopoulos et al.
8,400,022 B2 3/2013 Joannopoulos et al.
8,400,023 B2 3/2013 Joannopoulos et al.
8,400,024 B2 3/2013 Joannopoulos et al.
8,410,636 B2 4/2013 Kurs et al.
8,441,154 B2 5/2013 Karalis et al.
8,457,547 B2 6/2013 Meskens
8,461,719 B2 6/2013 Kesler et al.
8,461,720 B2 6/2013 Kurs et al.
8,461,721 B2 6/2013 Karalis et al.
8,461,722 B2 6/2013 Kurs et al.
8,461,817 B2 6/2013 Martin et al.
8,466,583 B2 6/2013 Karalis et al.
8,471,410 B2 6/2013 Karalis et al.
8,476,788 B2 7/2013 Karalis et al.
8,482,157 B2 7/2013 Cook et al.
8,482,158 B2 7/2013 Kurs et al.
8,487,480 B1 7/2013 Kesler et al.
8,497,601 B2 7/2013 Hall et al.
8,552,592 B2 10/2013 Schatz et al.
8,569,914 B2 10/2013 Karalis et al.
8,587,153 B2 11/2013 Schatz et al.
8,587,155 B2 11/2013 Giler et al.
8,598,743 B2 12/2013 Hall et al.
8,618,696 B2 12/2013 Karalis et al.
8,629,578 B2 1/2014 Kurs et al.
8,643,326 B2 2/2014 Campanella et al.
2002/0003141 A1* 1/2002 Blaker ..... F26B 3/343 219/778
2002/0032471 A1 3/2002 Loftin et al.
2002/0105343 A1 8/2002 Scheible et al.
2002/0118004 A1 8/2002 Scheible et al.
2002/0130642 A1 9/2002 Ettes et al.
2002/0167294 A1 11/2002 Odaohhara
2002/0180569 A1* 12/2002 Mongia ..... H01P 1/20381 333/204
2003/0038641 A1 2/2003 Scheible
2003/0062794 A1 4/2003 Scheible et al.
2003/0062980 A1 4/2003 Scheible et al.
2003/0071034 A1 4/2003 Thompson et al.
2003/0124050 A1 7/2003 Yadav et al.
2003/0126948 A1 7/2003 Yadav et al.
2003/0160590 A1 8/2003 Schaefer et al.
2003/0199778 A1 10/2003 Mickle et al.
2003/0214255 A1 11/2003 Baarman et al.
2004/0000974 A1 1/2004 Odenaal et al.
2004/0026998 A1 2/2004 Henriott et al.
2004/0100338 A1 5/2004 Clark
2004/0113847 A1 6/2004 Qi et al.
2004/0130425 A1 7/2004 Dayan et al.
2004/0130915 A1 7/2004 Baarman
2004/0130916 A1 7/2004 Baarman
2004/0142733 A1 7/2004 Parise
2004/0150934 A1 8/2004 Baarman
2004/0189246 A1 9/2004 Bulai et al.
2004/0201361 A1 10/2004 Koh et al.
2004/0222751 A1 11/2004 Mollema et al.
2004/0227057 A1 11/2004 Tuominen et al.
2004/0232845 A1 11/2004 Baarman et al.
2004/0233043 A1 11/2004 Yazawa et al.
2004/0267501 A1 12/2004 Freed et al.
2005/0007067 A1 1/2005 Baarman et al.
2005/0021134 A1 1/2005 Opie
2005/0027192 A1 2/2005 Govari et al.
2005/0033382 A1 2/2005 Single
2005/0085873 A1 4/2005 Gord et al.
2005/0093475 A1 5/2005 Kuennen et al.
2005/0104064 A1 5/2005 Hegarty et al.
2005/0104453 A1 5/2005 Vanderelli et al.
2005/0116650 A1 6/2005 Baarman
2005/0116683 A1 6/2005 Cheng et al.
2005/0122058 A1 6/2005 Baarman et al.
2005/0122059 A1 6/2005 Baarman et al.
2005/0125093 A1 6/2005 Kikuchi et al.
2005/0127849 A1 6/2005 Baarman et al.
2005/0127850 A1 6/2005 Baarman et al.
2005/0127866 A1 6/2005 Hamilton et al.
2005/0135122 A1 6/2005 Cheng et al.
2005/0140482 A1 6/2005 Cheng et al.
2005/0151511 A1 7/2005 Chary
2005/0156560 A1 7/2005 Shimaoka et al.
2005/0189945 A1 9/2005 Reiderman
2005/0194926 A1 9/2005 Di Stefano
2005/0253152 A1 11/2005 Klimov et al.
2005/0288739 A1 12/2005 Hassler, Jr. et al.
2005/0288740 A1 12/2005 Hassler, Jr. et al.
2005/0288741 A1 12/2005 Hassler, Jr. et al.
2005/0288742 A1 12/2005 Giordano et al.
2006/0001509 A1 1/2006 Gibbs
2006/0010902 A1 1/2006 Trinh et al.
2006/0022636 A1 2/2006 Xian et al.
2006/0053296 A1 3/2006 Busboom et al.
2006/0061323 A1 3/2006 Cheng et al.
2006/0066443 A1 3/2006 Hall
2006/0090956 A1 5/2006 Peshkovskiy et al.
2006/0132045 A1 6/2006 Baarman
2006/0164866 A1 7/2006 Vanderelli et al.
2006/0181242 A1 8/2006 Freed et al.
2006/0184209 A1 8/2006 John et al.
2006/0184210 A1 8/2006 Singhal et al.
2006/0185809 A1 8/2006 Elfrink et al.
2006/0199620 A1 9/2006 Greene et al.
2006/0202665 A1 9/2006 Hsu
2006/0205381 A1 9/2006 Beart et al.
2006/0214626 A1 9/2006 Nilson et al.
2006/0219448 A1 10/2006 Grieve et al.
2006/0238365 A1 10/2006 Vecchione et al.
2006/0270440 A1 11/2006 Shearer et al.
2006/0281435 A1 12/2006 Shearer et al.
2007/0010295 A1 1/2007 Greene et al.
2007/0013483 A1 1/2007 Stewart
2007/0016089 A1 1/2007 Fischell et al.

(56) References Cited

U.S. PATENT DOCUMENTS

| | | | |
|---|---|---|---|
| 2007/0021140 | A1 | 1/2007 | Keyes, IV et al. |
| 2007/0024246 | A1 | 2/2007 | Flaugher |
| 2007/0064406 | A1 | 3/2007 | Beart |
| 2007/0069687 | A1 | 3/2007 | Suzuki |
| 2007/0096875 | A1 | 5/2007 | Waterhouse et al. |
| 2007/0105429 | A1 | 5/2007 | Kohl et al. |
| 2007/0117596 | A1 | 5/2007 | Greene et al. |
| 2007/0126650 | A1 | 6/2007 | Guenther |
| 2007/0145830 | A1 | 6/2007 | Lee et al. |
| 2007/0164839 | A1 | 7/2007 | Naito |
| 2007/0171681 | A1 | 7/2007 | Baarman |
| 2007/0176840 | A1 | 8/2007 | Pristas et al. |
| 2007/0178945 | A1 | 8/2007 | Cook et al. |
| 2007/0182367 | A1 | 8/2007 | Partovi |
| 2007/0208263 | A1 | 9/2007 | John et al. |
| 2007/0222542 | A1 | 9/2007 | Joannopoulos et al. |
| 2007/0257636 | A1 | 11/2007 | Phillips et al. |
| 2007/0267918 | A1 | 11/2007 | Gyland |
| 2007/0276538 | A1 | 11/2007 | Kjellsson et al. |
| 2008/0012569 | A1 | 1/2008 | Hall et al. |
| 2008/0014897 | A1 | 1/2008 | Cook et al. |
| 2008/0030415 | A1 | 2/2008 | Homan et al. |
| 2008/0036588 | A1 | 2/2008 | Iverson et al. |
| 2008/0047727 | A1 | 2/2008 | Sexton et al. |
| 2008/0051854 | A1 | 2/2008 | Bulkes et al. |
| 2008/0067874 | A1 | 3/2008 | Tseng |
| 2008/0132909 | A1 | 6/2008 | Jascob et al. |
| 2008/0154331 | A1 | 6/2008 | John et al. |
| 2008/0176521 | A1 | 7/2008 | Singh et al. |
| 2008/0191638 | A1 | 8/2008 | Kuennen et al. |
| 2008/0197710 | A1 | 8/2008 | Kreitz et al. |
| 2008/0197802 | A1 | 8/2008 | Onishi et al. |
| 2008/0211320 | A1 | 9/2008 | Cook et al. |
| 2008/0238364 | A1 | 10/2008 | Weber et al. |
| 2008/0255901 | A1 | 10/2008 | Carroll et al. |
| 2008/0265684 | A1 | 10/2008 | Farkas |
| 2008/0266748 | A1 | 10/2008 | Lee |
| 2008/0272860 | A1 | 11/2008 | Pance |
| 2008/0273242 | A1 | 11/2008 | Woodgate et al. |
| 2008/0278264 | A1 | 11/2008 | Karalis et al. |
| 2008/0291277 | A1 | 11/2008 | Jacobsen et al. |
| 2008/0300657 | A1 | 12/2008 | Stultz |
| 2008/0300660 | A1 | 12/2008 | John |
| 2009/0010028 | A1 | 1/2009 | Baarman et al. |
| 2009/0015075 | A1 | 1/2009 | Cook et al. |
| 2009/0033280 | A1 | 2/2009 | Choi et al. |
| 2009/0033564 | A1 | 2/2009 | Cook et al. |
| 2009/0038623 | A1 | 2/2009 | Farbarik et al. |
| 2009/0045772 | A1 | 2/2009 | Cook et al. |
| 2009/0051224 | A1 | 2/2009 | Cook et al. |
| 2009/0058189 | A1 | 3/2009 | Cook |
| 2009/0058361 | A1 | 3/2009 | John |
| 2009/0067198 | A1 | 3/2009 | Graham et al. |
| 2009/0072627 | A1 | 3/2009 | Cook et al. |
| 2009/0072628 | A1 | 3/2009 | Cook et al. |
| 2009/0072629 | A1 | 3/2009 | Cook |
| 2009/0072782 | A1 | 3/2009 | Randall |
| 2009/0079268 | A1 | 3/2009 | Cook et al. |
| 2009/0079387 | A1 | 3/2009 | Jin et al. |
| 2009/0085408 | A1 | 4/2009 | Bruhn |
| 2009/0085706 | A1 | 4/2009 | Baarman et al. |
| 2009/0096413 | A1 | 4/2009 | Partovi et al. |
| 2009/0102292 | A1 | 4/2009 | Cook et al. |
| 2009/0108679 | A1 | 4/2009 | Porwal |
| 2009/0108997 | A1 | 4/2009 | Petterson et al. |
| 2009/0115628 | A1 | 5/2009 | Dicks et al. |
| 2009/0127937 | A1 | 5/2009 | Widmer et al. |
| 2009/0134712 | A1 | 5/2009 | Cook et al. |
| 2009/0146892 | A1 | 6/2009 | Shimizu et al. |
| 2009/0153273 | A1 | 6/2009 | Chen et al. |
| 2009/0160261 | A1 | 6/2009 | Elo |
| 2009/0161078 | A1 | 6/2009 | Wu et al. |
| 2009/0167449 | A1 | 7/2009 | Cook et al. |
| 2009/0174263 | A1 | 7/2009 | Baarman et al. |
| 2009/0179502 | A1 | 7/2009 | Cook et al. |
| 2009/0188396 | A1 | 7/2009 | Hofmann et al. |
| 2009/0189458 | A1 | 7/2009 | Kawasaki |
| 2009/0195332 | A1 | 8/2009 | Joannopoulos et al. |
| 2009/0195333 | A1 | 8/2009 | Joannopoulos et al. |
| 2009/0212636 | A1 | 8/2009 | Cook et al. |
| 2009/0213028 | A1 | 8/2009 | Cook et al. |
| 2009/0218884 | A1 | 9/2009 | Soar |
| 2009/0224608 | A1 | 9/2009 | Cook et al. |
| 2009/0224609 | A1 | 9/2009 | Cook et al. |
| 2009/0224723 | A1 | 9/2009 | Tanabe |
| 2009/0224856 | A1 | 9/2009 | Karalis et al. |
| 2009/0230777 | A1 | 9/2009 | Baarman et al. |
| 2009/0237194 | A1 | 9/2009 | Waffenschmidt et al. |
| 2009/0243394 | A1 | 10/2009 | Levine |
| 2009/0243397 | A1 | 10/2009 | Cook et al. |
| 2009/0251008 | A1 | 10/2009 | Sugaya |
| 2009/0261778 | A1 | 10/2009 | Kook |
| 2009/0267558 | A1 | 10/2009 | Jung |
| 2009/0267709 | A1 | 10/2009 | Joannopoulos et al. |
| 2009/0267710 | A1 | 10/2009 | Joannopoulos et al. |
| 2009/0271047 | A1 | 10/2009 | Wakamatsu |
| 2009/0271048 | A1 | 10/2009 | Wakamatsu |
| 2009/0273242 | A1 | 11/2009 | Cook |
| 2009/0273318 | A1 | 11/2009 | Rondoni et al. |
| 2009/0281678 | A1 | 11/2009 | Wakamatsu |
| 2009/0284082 | A1 | 11/2009 | Mohammadian |
| 2009/0284083 | A1 | 11/2009 | Karalis et al. |
| 2009/0284218 | A1 | 11/2009 | Mohammadian et al. |
| 2009/0284220 | A1 | 11/2009 | Toncich et al. |
| 2009/0284227 | A1 | 11/2009 | Mohammadian et al. |
| 2009/0284245 | A1 | 11/2009 | Kirby et al. |
| 2009/0284369 | A1 | 11/2009 | Toncich et al. |
| 2009/0286470 | A1 | 11/2009 | Mohammadian et al. |
| 2009/0286475 | A1 | 11/2009 | Toncich |
| 2009/0286476 | A1 | 11/2009 | Toncich et al. |
| 2009/0289595 | A1 | 11/2009 | Chen et al. |
| 2009/0299918 | A1 | 12/2009 | Cook et al. |
| 2009/0322158 | A1 | 12/2009 | Stevens et al. |
| 2009/0322280 | A1 | 12/2009 | Kamijo et al. |
| 2010/0015918 | A1 | 1/2010 | Liu et al. |
| 2010/0017249 | A1 | 1/2010 | Fincham et al. |
| 2010/0033021 | A1 | 2/2010 | Bennett |
| 2010/0034238 | A1 | 2/2010 | Bennett |
| 2010/0036773 | A1 | 2/2010 | Bennett |
| 2010/0038970 | A1 | 2/2010 | Cook et al. |
| 2010/0045114 | A1 | 2/2010 | Sample et al. |
| 2010/0052431 | A1 | 3/2010 | Mita |
| 2010/0052811 | A1 | 3/2010 | Smith et al. |
| 2010/0060077 | A1 | 3/2010 | Paulus et al. |
| 2010/0065352 | A1 | 3/2010 | Ichikawa |
| 2010/0066349 | A1 | 3/2010 | Lin et al. |
| 2010/0076524 | A1 | 3/2010 | Forsberg et al. |
| 2010/0081379 | A1 | 4/2010 | Cooper et al. |
| 2010/0094381 | A1 | 4/2010 | Kim et al. |
| 2010/0096934 | A1 | 4/2010 | Joannopoulos et al. |
| 2010/0102639 | A1 | 4/2010 | Joannopoulos et al. |
| 2010/0102640 | A1 | 4/2010 | Joannopoulos et al. |
| 2010/0102641 | A1 | 4/2010 | Joannopoulos et al. |
| 2010/0104031 | A1 | 4/2010 | Lacour |
| 2010/0109443 | A1 | 5/2010 | Cook et al. |
| 2010/0109445 | A1 | 5/2010 | Kurs et al. |
| 2010/0109604 | A1 | 5/2010 | Boys et al. |
| 2010/0115474 | A1 | 5/2010 | Takada et al. |
| 2010/0117454 | A1 | 5/2010 | Cook et al. |
| 2010/0117455 | A1 | 5/2010 | Joannopoulos et al. |
| 2010/0117456 | A1 | 5/2010 | Karalis et al. |
| 2010/0117596 | A1 | 5/2010 | Cook et al. |
| 2010/0123353 | A1 | 5/2010 | Joannopoulos et al. |
| 2010/0123354 | A1 | 5/2010 | Joannopoulos et al. |
| 2010/0123355 | A1 | 5/2010 | Joannopoulos et al. |
| 2010/0123452 | A1 | 5/2010 | Amano et al. |
| 2010/0123530 | A1 | 5/2010 | Park et al. |
| 2010/0127573 | A1 | 5/2010 | Joannopoulos et al. |
| 2010/0127574 | A1 | 5/2010 | Joannopoulos et al. |
| 2010/0127575 | A1 | 5/2010 | Joannopoulos et al. |
| 2010/0127660 | A1 | 5/2010 | Cook et al. |
| 2010/0133918 | A1 | 6/2010 | Joannopoulos et al. |
| 2010/0133919 | A1 | 6/2010 | Joannopoulos et al. |
| 2010/0133920 | A1 | 6/2010 | Joannopoulos et al. |

(56) References Cited

U.S. PATENT DOCUMENTS

2010/0141042 A1 6/2010 Kesler et al.
2010/0148589 A1 6/2010 Hamam et al.
2010/0148723 A1 6/2010 Cook et al.
2010/0151808 A1 6/2010 Toncich et al.
2010/0156346 A1 6/2010 Takada et al.
2010/0156355 A1 6/2010 Bauerle et al.
2010/0156570 A1 6/2010 Hong et al.
2010/0164295 A1 7/2010 Ichikawa et al.
2010/0164296 A1 7/2010 Kurs
2010/0164297 A1 7/2010 Kurs et al.
2010/0164298 A1 7/2010 Karalis et al.
2010/0171368 A1 7/2010 Schatz et al.
2010/0171370 A1 7/2010 Karalis et al.
2010/0179384 A1 7/2010 Hoeg et al.
2010/0181843 A1 7/2010 Schatz et al.
2010/0181844 A1 7/2010 Karalis et al.
2010/0181845 A1 7/2010 Fiorello et al.
2010/0181961 A1 7/2010 Novak et al.
2010/0181964 A1 7/2010 Huggins et al.
2010/0184371 A1 7/2010 Cook et al.
2010/0187911 A1 7/2010 Joannopoulos et al.
2010/0187913 A1 7/2010 Smith et al.
2010/0188183 A1 7/2010 Shpiro
2010/0190435 A1 7/2010 Cook et al.
2010/0190436 A1 7/2010 Cook et al.
2010/0194206 A1 8/2010 Burdo et al.
2010/0194207 A1 8/2010 Graham
2010/0194334 A1 8/2010 Kirby et al.
2010/0194335 A1 8/2010 Kirby et al.
2010/0201189 A1 8/2010 Kirby et al.
2010/0201201 A1 8/2010 Mobarhan et al.
2010/0201202 A1 8/2010 Kirby et al.
2010/0201203 A1 8/2010 Schatz et al.
2010/0201204 A1 8/2010 Sakoda et al.
2010/0201205 A1 8/2010 Karalis et al.
2010/0201310 A1 8/2010 Vorenkamp et al.
2010/0201312 A1 8/2010 Kirby et al.
2010/0201313 A1 8/2010 Vorenkamp et al.
2010/0201316 A1 8/2010 Takada et al.
2010/0201513 A1 8/2010 Vorenkamp et al.
2010/0207458 A1 8/2010 Joannopoulos et al.
2010/0210233 A1 8/2010 Cook et al.
2010/0213770 A1 8/2010 Kikuchi
2010/0213895 A1 8/2010 Keating et al.
2010/0217553 A1 8/2010 Von Novak et al.
2010/0219694 A1 9/2010 Kurs et al.
2010/0219695 A1 9/2010 Komiyama et al.
2010/0219696 A1 9/2010 Kojima
2010/0222010 A1 9/2010 Ozaki et al.
2010/0225175 A1 9/2010 Karalis et al.
2010/0225270 A1 9/2010 Jacobs et al.
2010/0225271 A1 9/2010 Oyobe et al.
2010/0225272 A1 9/2010 Kirby et al.
2010/0231053 A1 9/2010 Karalis et al.
2010/0231163 A1 9/2010 Mashinsky
2010/0231340 A1 9/2010 Fiorello et al.
2010/0234922 A1 9/2010 Forsell
2010/0235006 A1 9/2010 Brown
2010/0237706 A1 9/2010 Karalis et al.
2010/0237707 A1 9/2010 Karalis et al.
2010/0237708 A1 9/2010 Karalis et al.
2010/0237709 A1* 9/2010 Hall ..... B60L 11/182 307/104
2010/0244576 A1 9/2010 Hillan et al.
2010/0244577 A1 9/2010 Shimokawa
2010/0244578 A1 9/2010 Yoshikawa
2010/0244579 A1 9/2010 Sogabe et al.
2010/0244580 A1 9/2010 Uchida et al.
2010/0244581 A1 9/2010 Uchida
2010/0244582 A1 9/2010 Yoshikawa
2010/0244583 A1 9/2010 Shimokawa
2010/0244767 A1 9/2010 Turner et al.
2010/0244839 A1 9/2010 Yoshikawa
2010/0248622 A1 9/2010 Lyell Kirby et al.
2010/0253152 A1 10/2010 Karalis et al.
2010/0253281 A1 10/2010 Li
2010/0256481 A1 10/2010 Mareci et al.
2010/0256831 A1 10/2010 Abramo et al.
2010/0259108 A1 10/2010 Giler et al.
2010/0259109 A1 10/2010 Sato
2010/0259110 A1 10/2010 Kurs et al.
2010/0264745 A1 10/2010 Karalis et al.
2010/0264746 A1 10/2010 Kazama et al.
2010/0264747 A1 10/2010 Hall et al.
2010/0276995 A1 11/2010 Marzetta et al.
2010/0277003 A1 11/2010 Von Novak et al.
2010/0277004 A1 11/2010 Suzuki et al.
2010/0277005 A1 11/2010 Karalis et al.
2010/0277120 A1 11/2010 Cook et al.
2010/0277121 A1 11/2010 Hall et al.
2010/0289341 A1 11/2010 Ozaki et al.
2010/0289449 A1 11/2010 Elo
2010/0295505 A1 11/2010 Jung et al.
2010/0295506 A1 11/2010 Ichikawa
2010/0308939 A1 12/2010 Kurs
2010/0314946 A1 12/2010 Budde et al.
2010/0327660 A1 12/2010 Karalis et al.
2010/0327661 A1 12/2010 Karalis et al.
2010/0328044 A1 12/2010 Waffenschmidt et al.
2011/0004269 A1 1/2011 Strother et al.
2011/0012431 A1 1/2011 Karalis et al.
2011/0018361 A1 1/2011 Karalis et al.
2011/0025131 A1 2/2011 Karalis et al.
2011/0031928 A1 2/2011 Soar
2011/0043046 A1 2/2011 Joannopoulos et al.
2011/0043047 A1 2/2011 Karalis et al.
2011/0043048 A1 2/2011 Karalis et al.
2011/0043049 A1 2/2011 Karalis et al.
2011/0049995 A1 3/2011 Hashiguchi
2011/0049996 A1 3/2011 Karalis et al.
2011/0049998 A1 3/2011 Karalis et al.
2011/0074218 A1 3/2011 Karalis et al.
2011/0074346 A1 3/2011 Hall et al.
2011/0074347 A1 3/2011 Karalis et al.
2011/0089895 A1 4/2011 Karalis et al.
2011/0095618 A1 4/2011 Schatz et al.
2011/0115303 A1 5/2011 Baarman et al.
2011/0115431 A1 5/2011 Dunworth et al.
2011/0121920 A1 5/2011 Kurs et al.
2011/0128015 A1 6/2011 Dorairaj et al.
2011/0140544 A1 6/2011 Karalis et al.
2011/0148219 A1 6/2011 Karalis et al.
2011/0162895 A1 7/2011 Karalis et al.
2011/0169339 A1 7/2011 Karalis et al.
2011/0181122 A1 7/2011 Karalis et al.
2011/0193416 A1 8/2011 Campanella et al.
2011/0193419 A1 8/2011 Karalis et al.
2011/0198939 A1 8/2011 Karalis et al.
2011/0215086 A1 9/2011 Yeh
2011/0221278 A1 9/2011 Karalis et al.
2011/0227528 A1 9/2011 Karalis et al.
2011/0227530 A1 9/2011 Karalis et al.
2011/0241618 A1 10/2011 Karalis et al.
2011/0248573 A1 10/2011 Kanno et al.
2011/0254377 A1 10/2011 Wildmer et al.
2011/0254503 A1 10/2011 Widmer et al.
2011/0266878 A9 11/2011 Cook et al.
2011/0278943 A1 11/2011 Eckhoff et al.
2012/0001492 A9 1/2012 Cook et al.
2012/0001593 A1 1/2012 DiGuardo
2012/0007435 A1 1/2012 Sada et al.
2012/0007441 A1 1/2012 John et al.
2012/0025602 A1 2/2012 Boys et al.
2012/0032522 A1 2/2012 Schatz et al.
2012/0038525 A1 2/2012 Monsalve Carcelen et al.
2012/0062345 A1 3/2012 Kurs et al.
2012/0068549 A1 3/2012 Karalis et al.
2012/0086284 A1 4/2012 Capanella et al.
2012/0086867 A1 4/2012 Kesler et al.
2012/0091794 A1 4/2012 Campanella et al.
2012/0091795 A1 4/2012 Fiorello et al.
2012/0091796 A1 4/2012 Kesler et al.
2012/0091797 A1 4/2012 Kesler et al.
2012/0091819 A1 4/2012 Kulikowski et al.

(56) References Cited

U.S. PATENT DOCUMENTS

| | | | |
|---|---|---|---|
| 2012/0091820 | A1 | 4/2012 | Campanella et al. |
| 2012/0091949 | A1 | 4/2012 | Campanella et al. |
| 2012/0091950 | A1 | 4/2012 | Campanella et al. |
| 2012/0098350 | A1 | 4/2012 | Campanella et al. |
| 2012/0112531 | A1 | 5/2012 | Kesler et al. |
| 2012/0112532 | A1 | 5/2012 | Kesler et al. |
| 2012/0112534 | A1 | 5/2012 | Kesler et al. |
| 2012/0112535 | A1 | 5/2012 | Karalis et al. |
| 2012/0112536 | A1 | 5/2012 | Karalis et al. |
| 2012/0112538 | A1 | 5/2012 | Kesler et al. |
| 2012/0112691 | A1 | 5/2012 | Kurs et al. |
| 2012/0119569 | A1 | 5/2012 | Karalis et al. |
| 2012/0119575 | A1 | 5/2012 | Kurs et al. |
| 2012/0119576 | A1 | 5/2012 | Kesler et al. |
| 2012/0119698 | A1 | 5/2012 | Karalis et al. |
| 2012/0139355 | A1 | 6/2012 | Ganem et al. |
| 2012/0146575 | A1 | 6/2012 | Armstrong et al. |
| 2012/0153732 | A1 | 6/2012 | Kurs et al. |
| 2012/0153733 | A1 | 6/2012 | Schatz et al. |
| 2012/0153734 | A1 | 6/2012 | Kurs et al. |
| 2012/0153735 | A1 | 6/2012 | Karalis et al. |
| 2012/0153736 | A1 | 6/2012 | Karalis et al. |
| 2012/0153737 | A1 | 6/2012 | Karalis et al. |
| 2012/0153738 | A1 | 6/2012 | Karalis et al. |
| 2012/0153893 | A1 | 6/2012 | Schatz et al. |
| 2012/0184338 | A1 | 7/2012 | Kesler et al. |
| 2012/0206096 | A1 | 8/2012 | John |
| 2012/0223573 | A1 | 9/2012 | Schatz et al. |
| 2012/0228952 | A1 | 9/2012 | Hall et al. |
| 2012/0228953 | A1 | 9/2012 | Kesler et al. |
| 2012/0228954 | A1 | 9/2012 | Kesler et al. |
| 2012/0235500 | A1 | 9/2012 | Ganem et al. |
| 2012/0235501 | A1 | 9/2012 | Kesler et al. |
| 2012/0235502 | A1 | 9/2012 | Kesler et al. |
| 2012/0235503 | A1 | 9/2012 | Kesler et al. |
| 2012/0235504 | A1 | 9/2012 | Kesler et al. |
| 2012/0235505 | A1 | 9/2012 | Schatz et al. |
| 2012/0235566 | A1 | 9/2012 | Karalis et al. |
| 2012/0235567 | A1 | 9/2012 | Karalis et al. |
| 2012/0235633 | A1 | 9/2012 | Kesler et al. |
| 2012/0235634 | A1 | 9/2012 | Hall et al. |
| 2012/0239117 | A1 | 9/2012 | Kesler et al. |
| 2012/0242159 | A1 | 9/2012 | Lou et al. |
| 2012/0242225 | A1 | 9/2012 | Karalis et al. |
| 2012/0248884 | A1 | 10/2012 | Karalis et al. |
| 2012/0248886 | A1 | 10/2012 | Kesler et al. |
| 2012/0248887 | A1 | 10/2012 | Kesler et al. |
| 2012/0248888 | A1 | 10/2012 | Kesler et al. |
| 2012/0248981 | A1 | 10/2012 | Karalis et al. |
| 2012/0256494 | A1 | 10/2012 | Kesler et al. |
| 2012/0267960 | A1 | 10/2012 | Low et al. |
| 2012/0280765 | A1 | 11/2012 | Kurs et al. |
| 2012/0313449 | A1 | 12/2012 | Kurs et al. |
| 2012/0313742 | A1 | 12/2012 | Kurs et al. |
| 2013/0007949 | A1 | 1/2013 | Kurs et al. |
| 2013/0020878 | A1 | 1/2013 | Karalis et al. |
| 2013/0033118 | A1 | 2/2013 | Karalis et al. |
| 2013/0038402 | A1 | 2/2013 | Karalis et al. |
| 2013/0057364 | A1* | 3/2013 | Kesler ..... B60L 11/182 333/219.2 |
| 2013/0062966 | A1 | 3/2013 | Verghese et al. |
| 2013/0069441 | A1 | 3/2013 | Verghese et al. |
| 2013/0069753 | A1 | 3/2013 | Kurs et al. |
| 2013/0099587 | A1 | 4/2013 | Lou |
| 2013/0154383 | A1 | 6/2013 | Kasturi et al. |
| 2013/0154389 | A1 | 6/2013 | Kurs et al. |
| 2013/0159956 | A1 | 6/2013 | Verghese et al. |
| 2013/0175874 | A1 | 7/2013 | Lou et al. |
| 2013/0175875 | A1 | 7/2013 | Kurs et al. |
| 2013/0200716 | A1 | 8/2013 | Kesler et al. |
| 2013/0200721 | A1 | 8/2013 | Kurs et al. |
| 2013/0221744 | A1 | 8/2013 | Hall et al. |
| 2013/0278073 | A1 | 10/2013 | Kurs et al. |
| 2013/0278074 | A1 | 10/2013 | Kurs et al. |
| 2013/0278075 | A1 | 10/2013 | Kurs et al. |
| 2013/0300353 | A1 | 11/2013 | Kurs et al. |
| 2013/0307349 | A1 | 11/2013 | Hall et al. |
| 2013/0320773 | A1 | 12/2013 | Schatz et al. |
| 2013/0334892 | A1 | 12/2013 | Hall et al. |
| 2014/0002012 | A1 | 1/2014 | McCauley et al. |
| 2014/0070764 | A1 | 3/2014 | Keeling |
| 2014/0175892 | A1* | 6/2014 | Jonas ..... H01F 27/006 307/104 |

FOREIGN PATENT DOCUMENTS

| | | | |
|---|---|---|---|
| CN | 102439669 | | 5/2012 |
| CN | 103329397 | | 9/2013 |
| DE | 3824972 | A1 | 1/1989 |
| DE | 10029147 | A1 | 12/2001 |
| DE | 20016655 | U1 | 2/2002 |
| DE | 10221484 | A1 | 11/2003 |
| DE | 10304584 | A1 | 8/2004 |
| DE | 102005036290 | A1 | 2/2007 |
| DE | 102006044057 | A1 | 4/2008 |
| EP | 1335477 | A2 | 8/2003 |
| EP | 1 521 206 | | 4/2005 |
| EP | 1 524 010 | | 4/2005 |
| EP | 2357716 | A2 | 8/2011 |
| JP | 02097005 | A | 4/1990 |
| JP | 04265875 | A | 9/1992 |
| JP | 6-341410 | | 12/1994 |
| JP | 9-182323 | | 7/1997 |
| JP | 09298847 | A | 11/1997 |
| JP | 10164837 | A | 6/1998 |
| JP | 11075329 | A | 3/1999 |
| JP | 11188113 | A | 7/1999 |
| JP | 2001309580 | A | 11/2001 |
| JP | 2002010535 | | 1/2002 |
| JP | 2003179526 | A | 6/2003 |
| JP | 2004166459 | A | 6/2004 |
| JP | 2004201458 | A | 7/2004 |
| JP | 2004-229144 | | 8/2004 |
| JP | 2005057444 | A | 3/2005 |
| JP | 2005149238 | A | 6/2005 |
| JP | 2006-074848 | | 3/2006 |
| JP | 2007505480 | T | 3/2007 |
| JP | 2007-266892 | | 10/2007 |
| JP | 2007537637 | A | 12/2007 |
| JP | 2008508842 | A | 3/2008 |
| JP | 2008206231 | A | 9/2008 |
| JP | 2008206327 | A | 9/2008 |
| JP | 2011072074 | A | 4/2011 |
| JP | 2012-504387 | | 2/2012 |
| JP | 2013-543718 | | 12/2013 |
| KR | 10-2007-0017804 | | 2/2007 |
| KR | 1020080007635 | A | 1/2008 |
| KR | 1020090122072 | A | 11/2009 |
| KR | 102011005092 | A | 5/2011 |
| SG | 112842 | | 7/2005 |
| WO | 9217929 | A1 | 10/1992 |
| WO | 9323908 | A1 | 11/1993 |
| WO | 9428560 | A1 | 12/1994 |
| WO | WO 95/11545 | | 4/1995 |
| WO | 9602970 | A1 | 2/1996 |
| WO | 9850993 | A1 | 11/1998 |
| WO | 0077910 | A1 | 12/2000 |
| WO | 03092329 | A1 | 11/2003 |
| WO | 03096361 | A1 | 11/2003 |
| WO | 03096512 | A2 | 11/2003 |
| WO | WO 2004/015885 | | 2/2004 |
| WO | 2004038888 | A2 | 5/2004 |
| WO | 2004055654 | A2 | 7/2004 |
| WO | 2004073150 | A1 | 8/2004 |
| WO | 2004073166 | A2 | 8/2004 |
| WO | 2004073176 | A2 | 8/2004 |
| WO | 2004073177 | A2 | 8/2004 |
| WO | 2004112216 | A1 | 12/2004 |
| WO | 2005024865 | A2 | 3/2005 |
| WO | 2005060068 | A1 | 6/2005 |
| WO | 2005109597 | A1 | 11/2005 |
| WO | 2005109598 | A1 | 11/2005 |
| WO | 2006011769 | A1 | 2/2006 |
| WO | 2007008646 | A2 | 1/2007 |

(56) References Cited

FOREIGN PATENT DOCUMENTS

| | | | |
|---|---|---|---|
| WO | 2007020583 | A2 | 2/2007 |
| WO | 2007042952 | A1 | 4/2007 |
| WO | 2007084716 | A2 | 7/2007 |
| WO | 2007084717 | A2 | 7/2007 |
| WO | 2008109489 | A2 | 9/2008 |
| WO | 2008118178 | A1 | 10/2008 |
| WO | 2009009559 | A1 | 1/2009 |
| WO | 2009018568 | A2 | 2/2009 |
| WO | 2009023155 | A2 | 2/2009 |
| WO | 2009023646 | A2 | 2/2009 |
| WO | 2009033043 | A2 | 3/2009 |
| WO | 2009062438 | A1 | 5/2009 |
| WO | 2009070730 | A2 | 6/2009 |
| WO | 2009126963 | A2 | 10/2009 |
| WO | 2009140506 | A1 | 11/2009 |
| WO | 2009149464 | A2 | 12/2009 |
| WO | 2009155000 | A2 | 12/2009 |
| WO | 2010030977 | A2 | 3/2010 |
| WO | 2010036980 | A1 | 4/2010 |
| WO | 2010039967 | A1 | 4/2010 |
| WO | 2010090538 | A1 | 8/2010 |
| WO | 2010090539 | A1 | 8/2010 |
| WO | 2010093997 | A1 | 8/2010 |
| WO | 2010104569 | A1 | 9/2010 |
| WO | 2011061388 | A1 | 5/2011 |
| WO | 2011061821 | A1 | 5/2011 |
| WO | 2011062827 | A2 | 5/2011 |
| WO | 2011112795 | A1 | 9/2011 |
| WO | 2012037279 | A1 | 3/2012 |
| WO | 2012170278 | A2 | 12/2012 |
| WO | 2012170278 | A3 | 1/2013 |
| WO | 2013013235 | A2 | 1/2013 |
| WO | 2013020138 | A2 | 2/2013 |
| WO | 2013036947 | A2 | 3/2013 |
| WO | 2013020138 | A3 | 4/2013 |
| WO | 2013059441 | A1 | 4/2013 |
| WO | 2013013235 | A3 | 5/2013 |
| WO | 2013036947 | A3 | 5/2013 |
| WO | 2013067484 | A1 | 5/2013 |
| WO | 2013113017 | A1 | 8/2013 |
| WO | 2013142840 | A1 | 9/2013 |
| WO | WO 2014/004843 | | 1/2014 |

OTHER PUBLICATIONS

Ahmadian, M. et al., "Miniature Transmitter for Implantable Micro Systems", *Proceedings of the 25th Annual International Conference of the IEEE EMBS* Cancun, Mexico, pp. 3028-3031 (Sep. 17-21, 2003).

Borenstein, S., "Man tries wirelessly boosting batteries", AP Science Writer, Boston.com, (See http://www.boston.com/business/technology/articles/2006/11/15/man_tries_wirelessly_b . . . ) (Nov. 15, 2006).

Budhia, M. et al., "A New IPT Magnetic Coupler for Electric Vehicle Charging Systems", IECON 2010—36th Annual Conference on IEEE Industrial Electronics Society, Glendale, AZ, pp. 2487-2492 (Nov. 7-10, 2010).

Budhia, M. et al., "Development and evaluation of single sided flux couplers for contactless electric vehicle charging", 2011 IEEE Energy Conversion Congress and Exposition (ECCE), Phoenix, AZ, pp. 614-621 (Sep. 17-22, 2011).

Budhia, M. et al.,"Development of a Single-Sided Flux Magnetic Coupler for Electric Vehicle IPT", *IEEE Transactions on Industrial Electronics*, vol. 60:318-328 (Jan. 2013).

Eisenberg, Anne, "Automatic Recharging, From a Distance", The New York Times, (see www.nytimes.com/2012/03/11/business/built-in-wireless-chargeing-for-electronic-devices.html?_r=0) (published on Mar. 10, 2012).

Fan, Shanhui et al., "Rate-Equation Analysis of Output Efficiency and Modulation Rate of Photomic-Crystal Light-Emitting Diodes", IEEE Journal of Quantum Electronics, vol. 36(10):1123-1130 (Oct. 2000).

Ferris, David, "How Wireless Charging Will Make Life Simpler (and Greener)", Forbes (See forbes.com/sites/davidferris/2012/07/24/how-wireless-charging-will-make-life-simpler-and-greener/print/) (dated Jul. 24, 2012).

Finkenzeller, Klaus, "RFID Handbook—Fundamentals and Applications in Contactless Smart Cards", Nikkan Kohgyo-sya, Kanno Taihei, first version, pp. 32-37, 253 (Aug. 21, 2001).

Finkenzeller, Klaus, "RFID Handbook (2nd Edition)", The Nikkan Kogyo Shimbun, Ltd., pp. 19, 20, 38, 39, 43, 44, 62, 63, 67, 68, 87, 88, 291, 292 (Published on May 31, 2004).

Ho, S. L. et al., "A Comparative Study Between Novel Witricity and Traditional Inductive Magnetic Coupling in Wireless Charging", IEEE Transactions on Magnetics, vol. 47(5):1522-1525 (May 2011).

Moskvitch, Katia, "Wireless charging—the future for electric cars?", BBC News Technology (See www.bbc.co.uk/news/technology-14183409) (dated Jul. 21, 2011).

Schneider, D. "A Critical Look at Wireless Power", *IEEE Spectrum*, pp. 35-39 (May 2010).

Stewart, W., "The Power to Set you Free", Science, vol. 317:55-56 (Jul. 6, 2007).

Yates, David C. et al., "Optimal Transmission Frequency for Ultralow-Power Short-Range Radio Links", IEEE Transactions on Circuits and Systems—1, Regular Papers, vol. 51:1405-1413 (Jul. 2004).

Ziaie, Babak et al., "A Low-Power Miniature Transmitter Using a Low-Loss Silicon Platform for Biotelemetry", *Proceedings—19th International Conference IEEE/EMBS*, pp. 2221-2224, (Oct.30-Nov. 2, 1997) 4 pages.

"In pictures: A year in technology", BBC News, Dec. 28, 2007, 2 pages http://news.bbc.co.uk/2/hi/in_pictures/7129507.stm.

European Application No. 06786588.1, Examination Report mailed Jan. 15, 2009, 5 pages.

Extended European Search Report for 11184066.6 mailed Mar. 28, 2013, 7 pages.

U.S. Appl. No. 12/613,686, Notice of Allowance mailed Jan. 6, 2011, Jan. 6, 2011, 10 pages.

U.S. Appl. No. 12/613,686, Notice of Allowance mailed Mar. 7, 2011, Mar. 7, 2011, 8 pages.

Australian Application Serial No. 200626937 4, Examination Report mailed Sep. 18, 2008, 5 pages.

U.S. Appl. No. 60/698,442, "Wireless Non-Radiative Energy Transfer", filed Jul 12, 2005, 14 pages.

U.S. Appl. No. 60/908,383, "Wireless Energy Transfer", filed Mar. 27, 2007, 80 pages.

U.S. Appl. No. 60/908,666, "Wireless Energy Transfer", filed Mar. 28, 2007, 108 pages.

Abe, et al., "A Noncontact Charger Using a Resonant Converter with Parallel Capacitor of the Secondary Coil", vol. 36, No. 2, Mar./Apr. 2000, pp. 444-451.

Altchev, et al., "Efficient Resonant Inductive Coupling Energy Transfer Using New Magnetic and Design Criteria", IEEE, Jun. 16, 2005, pp. 1293-1298.

Aoki, et al., "Observation of Strong Coupling Between One Atom and a Monolithic Microresonator", Nature, vol. 443, Oct. 12, 2006, pp. 671-674.

Apneseth, et al., "Introducing wireless proximity switches", ABB Review, Apr. 2002, pp. 42-49.

Baker, et al., "Feedback Analysis and Design of RF Power Links for Low-Power Bionic Systems", IEEE Transactions on Biomedical Circuits and Systems, vol. 1, No. 1, Mar. 2007, pp. 28-38.

Balanis, Constantine A. , "Antenna Theory: Analysis and Design", 3rd Edition Sections 4.2 4.3 5.2 5.3 (John Wiley & Sons Inc.), 2005, 40 pages.

Berardelli, Phil , "Outlets are Out", ScienceNOW Daily News, Science Now, Nov. 14, 2006, 2 pages http://sciencenow.sciencemag.org/ cgi/content/full/2006/1114/2.

Biever, Celeste, "Evanescent coupling could power gadgets wirelessly", NewScientistsTech.com, Nov. 15, 2006, 2 pages http://www. newscientisttech.com/article.ns?id=dn1 0575&print=true.

Borenstein, Seth , "Man tries wirelessly boosting batteries", (The Associated Press), USA Today, Nov. 16, 2006, 1 page.

(56) References Cited

OTHER PUBLICATIONS

Boyle, Alan, "Electro-nirvana? Not so fast", MSNBC, Jun. 8, 2007, 1 page http://cosmiclog.nbcnews.com/_news/2007/06/08/4350760-electro-nirvana-not-so-fast?lite.
Bulkeley, William M. , "MIT Scientists Pave the Way for Wireless Battery Charging", The Wall Street Journal, Jun. 8, 2007, 2 pages http://online.wsj.com/article/SB118123955549228045.html?mod=googlenews_wsj.
Burri, et al., "Invention Description", Feb. 5, 2008, 16 pages.
Cass, Stephen, "Air Power—Wireless data connections are common—now scientists are working on wireless power", Sponsored by IEEE Spectrum, Nov. 2006, 2 pages http://spectrum.ieee.org/computing/hardware/air-power.
Castelvecchi, Davide, "The Power of Induction—Cutting the last cord could resonate with our increasingly gadget dependent lives", Science News Online, vol. 172, No. 3, Jul. 21, 2007, 6 pages.
Chang, Angela, "Recharging the Wireless Way—Even physicists forget to recharge their cell phones sometimes.", PC Magazine, ABC News Internet Ventures, Dec. 12, 2006, 1 page.
Chinaview, "Scientists light bulb with 'wireless electricity'", Jun. 2007, 1 page www.Chinaview.cn, http://news.xinhuanet.com/english/2007-6/08/content_6215681.htm.
Cooks, Gareth, "The vision of an MIT physicist: Getting rid of pesky rechargers", Boston.com, Dec. 11, 2006, 1 page.
Derbyshire, David, "The end of the plug? Scientists invent wireless device that beams electricity through your home", Daily Mail, Jun. 7, 2007, 3 pages http://www.dailymail.co.uk/pages/live/articles/technology/technology.html?in_article id=4.
Esser, et al., "A New Approach to Power Supplies for Robots.", IEEE, vol. 27, No. 5, Sep./Oct. 1991, pp. 872-875.
Fenske, et al., "Dielectric Materials at Microwave Frequencies", Applied Microwave & Wireless, 2000, pp. 92-100.
Fernandez, C. et al., "A simple dc-dc converter for the power supply of a cochlear implant", Power Electronics Specialist Conference, IEEE 34th Annual, Jun. 2003, pp. 1965-1970.
Fildes, Jonathan, "Physics Promises Wireless Power", Science and Technology Reporter, BBC News, Nov. 15, 2006, 3 pages.
Fildes, Jonathan, "The technology with impact 2007", BBC News, Dec. 27, 2007, 3 pages.
Fildes, Jonathan , "Wireless energy promise powers up", BBC News, Jun. 7, 2007, 3 pages http://news.bbc.co.uk/2/hi/technology/6725955.stm.
Freedman, David H., "Power on a Chip", MIT Technology Review, Nov. 2004, 3 pages.
Hadley, Franklin , "Goodbye Wires-MIT Team Experimentally Demonstrates Wireless Power Transfer, Potentially 32 Useful for Power Laptops, Cell-Phones Without Cords", Massachusetts Institute of Technology, Institute for Soldier Nanotechnologies, Jun. 7, 2007, 3 pages http://web.mit.edu/newsoffice/2007/wireless-0607.html.
Haus, H A., "Waves and Fields in Optoelectronics", Chapter 7: Coupling of Modes—Reasonators and Couplers, 1984, pp. 197-234.
Heikkinen, et al., "Performance and Efficiency of Planar Rectennas for Short-Range Wireless Power Transfer at 2.45 GHz", Microwave and Optical Technology Letters, vol. 31, No. 2, Oct. 20, 2001, pp. 86-91.
Highfield, Roger, "Wireless revolution could spell end of plugs", (Science Editor), Telegraph.co.uk, Jun. 7, 2007, 3 pages http://www.telegraph.co.uk/news/main.jhtml?xml=/news/2007/06/07/nwireless1 07.xml.
Hirai, et al., "Integral Motor with Driver and Wireless Transmission of Power and Information for Autonomous Subspindle Drive", IEEE, vol. 15, No. 1, Jan. 2000, pp. 13-20.
Hirai, et al., "Practical Study on Wireless Transmission of Power and Information for Autonomous Decentralized Manufacturing System", IEEE, vol. 46, No. 2, Apr. 1999, pp. 349-359.
Hirai, et al., "Study on Intelligent Battery Charging Using Inductive Transmission of Power and Information", IEEE, vol. 15, No. 2, Mar. 2000, pp. 335-345.
Hirai, et al., "Wireless Transmission of Power and Information and Information for Cableless Linear Motor Drive", IEEE, vol. 15, No. 1, Jan. 2000, pp. 21-27.
Hirayama, Makoto, "Splashpower—World Leaders in Wireless Power", PowerPoint presentation, Splashpower Japan, Sep. 3, 2007, 30 pages.
Infotech Online, "Recharging gadgets without cables", infotech.indiatimes.com, Nov. 17, 2006, 1 page.
Intel News Release, "Intel CTO Says Gap between Humans, Machines Will Close by 2050", Printed Nov. 6, 2009, 2 pages intel.com/ . . . /20080821comp.htm?iid=S.
Jackson, J. D., "Classical Electrodynamics", 3rd Edition, Wiley, New York, 1999, pp. 201-203.
Jackson, J. D., "Classical Electrodynamics", 3rd Edition, Wiley, New York, Sections 1.11, 5.5, 5.17, 6.9, 8.1, 8.8, 9.2, and 9.3, 1999, pp. 40-43, 181-184, 215-218, 264-267, 352-356, 371-374, 410-416.
Jacob, M. V. et al., "Lithium Tantalate—A High Permittivity Dielectric Material for Microwave Communication Systems", Proceedings of IEEE TENCON—Poster Papers, 2003, pp. 1362-1366.
Karalis, Aristeidis et al., "Efficient Wireless non-radiative mid-range energy transfer", Annals of Physics, vol. 323, 2008, pp. 34-48.
Karalls, Aristeidis, "Electricity Unplugged", Feature: Wireless Energy Physics World, physicsworld .com, Feb. 2009, pp. 23-25.
Kawamura, et al., "Wireless Transmission of Power and Information Through One High-Frequency Resonant AC Link Inverter for Robot Manipulator Applications", IEEE, vol. 32, No. 3, May/Jun. 1996, pp. 503-508.
Konishi, Yoshihiro, "Microwave Electronic Circuit Technology", (Marcel Dekker Inc. New York NY 1998), Chapter 4, 1998, pp. 145-197.
Kurs, A et al., "Optimized design of a low-resistance electrical conductor for the multimegahertz range", Applied Physics Letters, vol. 98, Apr. 2011, pp. 172504-1-172504-3.
Kurs, Andre et al., "Simultaneous mid-range power transfer to multiple devices", Applied Physics Letters, vol. 96, Jan. 26, 2010, pp. 044102-1-044102-3.
Kurs, Andre et al., "Wireless Power Transfer via Strongly Coupled Magnetic Resonances", Science vol. 317, No. 5834, Jul. 6, 2007, pp. 83-86.
Lamb, Gregory M., "Look Ma—no wires! —Electricity broadcast through the air may someday run your home", The Christian Science Monitor, Nov. 15, 2006, 2 pages http://www.csmonitor.com/2006/1116/p14s01-stct.html.
Lee, "Antenna Circuit Design for RFID Applications", Microchip Technology Inc., AN710, Jan. 21, 2003, 50 pages.
Lee, "RFID Coil Design", Microchip Technology Inc., AN678, 1998, 21 pages.
Liang, et al., "Silicon waveguide two-photon absorption detector at 1.5 μm wavelength for autocorrelation measurements", Applied Physics Letters, vol. 81, No. 7, Aug. 12, 2002, pp. 1323-1325.
Markoff, John, "Intel Moves to Free Gadgets of Their Recharging Cords", The New York Times—nytimes.com, Aug. 21, 2008, 2 pages.
Mediano, A. et al., "Design of class E amplifier with nonlinear and linear shunt capacitances for any duty cycle", IEEE Trans. Microwave Theor. Tech., vol. 55, No. 3, Mar. 2007, pp. 484-492.
Microchip Technology Inc., "MCRF355/360 Reader Reference Design", microID 13.56 MHz Design Guide, 2001, 24 pages.
Minkel, J R., "Wireless Energy Lights Bulb from Seven Feet Away—Physicists vow to cut the cord between your laptop battery and the wall socket—with just a simple loop of wire", Scientific American, Jun. 7, 2007, 1 page http://www.scientificamerican.com/article.cfm?id=wireless-energy-lights-bulb-from-seven-feet-away.
Minkel, J R., "Wireless Energy Transfer May Power Devices at a Distance", Scientific American, Nov. 14, 2006, 1 page.
Morgan, James, "Lab report: Pull the plug for a positive charge", The Herald, Web Issue 2680, Nov. 16, 2006, 3 pages.
O'Brien, et al., "Analysis of Wireless Power Supplies for Industrial Automation Systems", IEEE, Nov. 2-6, 2003, pp. 367-72.
O'Brien, et al., "Design of Large Air-Gap Transformers for Wireless Power Supplies", IEEE, Jun. 15-19, 2003, pp. 1557-1562.

(56) References Cited

OTHER PUBLICATIONS

International Application Serial No. PCT/US2006/026480, International Preliminary Report on Patentability mailed Jan. 29, 2008, 8 pages.
International Application Serial No. PCT/US2006/026480, International Search Report and Written Opinion mailed Dec. 21, 2007, 14 pages.
International Application Serial No. PCT/US2007/070892, International Preliminary Report on Patentability mailed Sep. 29, 2009, 14 pages.
International Application Serial No. PCT/US2007/070892, International Search Report and Written Opinion mailed Mar. 3, 2008, 21 pages.
International Application Serial No. PCT/US2009/043970, International Search Report and Written Opinion mailed Jul. 14, 2009, 9 pages.
International Application Serial No. PCT/US2009/058499, International Preliminary Report on Patentability mailed Mar. 29, 2011, 5 pages.
International Application Serial No. PCT/US2009/058499, International Search Report and Written Opinion mailed Dec. 10, 2009, 6 pages.
International Application Serial No. PCT/US2009/059244, International Search Report mailed Dec. 7, 2009, 12 pages.
International Application Serial No. PCT/US2010/024199, International Preliminary Report on Patentability mailed Aug. 25, 2011, 8 pages.
International Application Serial No. PCT/US2010/024199, Search Report and Written Opinion mailed May 14, 2010, 12 pages.
International Application Serial No. PCT/US2011/027868, International Preliminary Report on Patentability mailed Sep. 20, 2012, 8 pages.
International Application Serial No. PCT/US2011/027868, International Search Report and Written mailed Jul. 5, 2011, 9 pages.
International Application Serial No. PCT/US2011/051634 , International Search Report and Written Opinion mailed Jan. 6, 2012, 11 pages.
International Application Serial No. PCT/US2011/051634, International Preliminary Report on Patentability mailed Mar. 28, 2013, 8 pages.
International Application No. PCT/US2011/054544, International Search Report and Written Opinion mailed Jan. 30, 2012, 17 pages.
International Application Serial No. PCT/US2012/040184, International Search Report and Written Opinion mailed Nov. 28, 2012, 8 pages.
International Application Serial No. PCT/US2012/047844, International Search Report and Written Opinion mailed Mar. 25, 2013, 9 pages.
International Application Serial No. PCT/US2012/049777, International Search Report and Written Opinion mailed Jan. 23, 2013, 10 pages.
International Application Serial No. PCT/US2012/054490, International Search Report and Written Opinion mailed Feb. 28, 2013, 8 pages.
International Application Serial No. PCT/US2012/060793, International Search Report and Written Opinion mailed Mar. 8, 2013, 13 pages.
International Application Serial No. PCT/US2012/063530, International Search Report and Written Opinion mailed Mar. 13, 2013, 16 pages.
International Application Serial No. PCT/US2013/023478, International Search Report and Written Opinion mailed Jun. 25, 2013, 15 pages.
International Application Serial No. PCT/US2013/033599, International Search Report and Written Opinion mailed Jul. 25, 2013, 13 pages.
Pendry, J B., "A Chiral Route to Negative Refraction", Science, vol. 306, Nov. 19, 2004, pp. 1353-1355.
Peterson, Gary, "MIT WiTricity Not So Original After All", Feed Line No. 9:, http://www.tfcbooks.com/articles/ witricity.htm, accessed on Nov. 12, 2009, pp. 1-3.
Physics Today, "Unwired Energy", section in Physics Update, Jan. 2007, p. 26 www.physicstoday.org, http://arxiv.org/abs/ physics/0611063.
Physics Today, "Unwired energy questions asked answered", Sep. 2007, pp. 16-17.
Powercast LLC, "White Paper", Powercast simply wire free, 2003, 2 pages.
PR News Wire, "The Big Story for CES 2007: The public debut of eCoupled Intelligent Wireless Power", Press Release, Fulton Innovation LLC, Las Vegas, NV, Dec. 27, 2006, 3 pages.
Press Release, "The world's first sheet-type wireless power transmission system: Will a socket be replaced by e-wall?", Public Relations Office, School of Engineering, University of Tokyo, Japan, Dec. 12, 2006, 4 pages.
PressTV, "Wireless power transfer possible", Jun. 11, 2007, 1 page http://edition.presstv.ir/detail/12754.html.
Reidy, Chris (Globe Staff), "MIT discovery could unplug your iPod forever", Jun. 7, 2007, 3 pages Boston.com, http://www.boston.com/ business/ticker/2007/06/mit_discovery_c.html.
Risen, Clay, "Wireless Energy", The New York Times, Dec. 9, 2007, 1 page.
Sakamoto, et al., "A Novel Circuit for Non-Contact Charging Through Electro-Magnetic Coupling", IEEE, Jun. 29-Jul. 3, 1992, pp. 168-174.
Scheible, G. et al., "Novel Wireless Power Supply System for Wireless Communication Devices in Industrial Automation Systems", IEEE, Nov. 5-8, 2002, pp. 1358-1363.
Schneider, David, "Electrons Unplugged. Wireless power at a distance is still far away", IEEE Spectrum, May 2010, pp. 35-39.
Schuder, J. C. et al., "Energy Transport Into the Closed Chest From a Set of Very-Large Mutually Orthogonal Coils", Communication Electronics, vol. 64, Jan. 1963, pp. 527-534.
Schuder, John C. et al., "An Inductively Coupled RF System for the Transmission of 1 kW of Power Through the Skin", IEEE Transactions on Bio-Medical Engineering, vol. BME-18, No. 4, Jul. 1971, pp. 265-273.
Schuder, John C., "Powering an Artificial Heart: Birth of the Inductively Coupled-Radio Frequency System in 1960", Artificial Organs, vol. 26, No. 11, Nov. 2002, pp. 909-915.
Schutz, J. et al., "Load Adaptive Medium Frequency Resonant Power Supply", IEEE, Nov. 2002, pp. 282-287.
Sekitani, et al., "A large-area flexible wireless power transmission sheet using printed plastic MEMS switches and organic field-effect transistors", IEDM '06. International Electron Devices Meeting, 2006, Dec. 11-13, 2006, 4 pages.
Sekitani, et al., "A large-area wireless power-transmission sheet using printed organic transistors and plastic MEMS switches", Nature Materials 6: 413-417 (Jun. 1, 2007) Published online Apr. 29, 2007, 5 pages.
Sekiya, H. et al., "FM/PWM control scheme in class DE inverter", IEEE Trans. Circuits Syst. I, vol. 51, No. 7, Jul. 2004, pp. 1250-1260.
Senge, Miebi, "MIT's wireless electricity for mobile phones", Vanguard, Jun. 11, 2007, 1 page http://www.vanguardngr.com/articles/2002/features/gsm/gsm211062007.htm.
Sensiper, S., "Electromagnetic wave propogation on helical conductors", Technical Report No. 194 (based on PhD Thesis), Massachusetts Institute of Technology, May 16, 1951, 126 pages.
Soljacic, "Wireless Non-Radiative Energy Transfer", PowerPoint presentation, Massachusetts Institute of Technology, Oct. 6, 2005, 14 pages.
Soljacic, Marin et al., "Photonic-crystal slow-light enhancement of nonlinear phase sensitivity", J. Opt. Soc. Am B, vol. 19, No. 9, Sep. 2002, pp. 2052-2059.
Soljacic, Marin et al., "Wireless Energy Transfer Can Potentially Recharge Laptops Cell Phones Without Cords", Nov. 14, 2006, 3 pages.
Soljacic, Marin, "Wireless nonradiative energy transfer", Visions of Discovery New Light on Physics, Cosmology and Consciousness, Cambridge University Press, New York, 2011, pp. 530-542.

(56) References Cited

OTHER PUBLICATIONS

Someya, Takao, "The world's first sheet-type wireless power transmission system", Press Interview Handout, University of Tokyo,Dec. 12, 2006, 18 pages.
Staelin, David H. et al., "Electromagnetic Waves", (Prentice Hall Upper Saddle River, New Jersey, 1998), Chapters 2, 3, 4, and 8, 1998, pp. 46-176 and 336-405.
Stark III, Joseph C. , "Wireless Power Transmission Utilizing a Phased Array of Tesla Coils", Master Thesis, Massachusetts Institute of Technology, 2004, 247 pages.
Tang, S.C et al., "Evaluation of the Shielding Effects on Printed-Circuit-Board Transformers Using Ferrite Plates and Copper Sheets", IEEE Transactions on Power Electronics, vol. 17, No. 6, Nov. 2002., pp. 1080-1088.
Tesla, Nikola, "High Frequency Oscillators for Electro-Therapeutic and Other Purposes", The Electrical Engineer, vol. XXVI, No. 550, Nov. 17, 1898, 11 pages.
Tesla, Nikola, "High Frequency Oscillators for Electro-Therapeutic and Other Purposes", Proceedings of the IEEE, vol. 87, No. 7, Jul. 1999, pp. 1282-1292.
Texas Instruments, "HF Antenna Design Notes", Technical Application Report, Literature No. 11-08-26-003, Sep. 2003, 47 pages.
Thomsen, et al., "Ultrahigh speed all-optical demultiplexing based on two-photon absorption in a laser diode", Electronics Letters, vol. 34, No. 19, Sep. 17, 1998, pp. 1871-1872.
UPM RAFSEC, "Tutorial overview of inductively coupled RFID Systems", http://www.rafsec.com/rfidsystems.pdf, May 2003, 7 pages.
Vandevoorde, et al., "Wireless energy t830ransfer for stand-alone systems: a comparison between low and high power applicability", Sensors and Actuators A 92, Jul. 17, 2001, pp. 305-311.
Vilkomerson, David et al., "Implantable Doppler System for Self-Monitoring Vascular Grafts", IEEE Ultrasonics Symposium, Aug. 23-27, 2004, pp. 461-465.
Villeneuve, Pierre R. et al., "Microcavities in photonic crystals: Mode symmetry, tunability, and coupling efficiency", Physical Review B, vol. 54, No. 11, Sep. 15, 1996, pp. 7837-7842.
Wen, Geyi, "A Method for the Evaluation of Small Antenna Q.", IEEE Transactions on Antennas and Propagation, vol. 51, No. 8, Aug. 2003, pp. 2124-2129.
Yariv, Amnon et al., "Coupled-resonator optical waveguide: a proposal and analysis", Optics Letters, vol. 24, No. 11, Jun. 1, 1999, pp. 711-713.
Zierhofer, Clemens M. et al., "High-Efficiency Coupling-Insensitive Transcutaneous Power and Data Transmission Via an Inductive Link", IEEE Transactions on Biomedical Engineering, vol. 37 No. 7, Jul. 1990, pp. 716-722.

* cited by examiner

RESONATOR ENCLOSURE

CROSS-REFERENCE TO RELATED APPLICATIONS

This application claims the benefit of U.S. provisional patent application 61/703,127 filed Sep. 19, 2012.

BACKGROUND

Field

This disclosure relates to wireless energy transfer, methods, systems and apparati to accomplish such transfer, and applications.

Description of the Related Art

Energy or power may be transferred wirelessly using a variety of techniques as detailed, for example, in commonly owned U.S. patent application Ser. No. 12/789,611 published on Sep. 23, 2010 as U.S. Pat. Pub. No. 2010/0237709 and entitled "RESONATOR ARRAYS FOR WIRELESS ENERGY TRANSFER," U.S. patent application Ser. No. 12/722,050 published on Jul. 22, 2010 as U.S. Pat. Pub. No. 2010/0181843 and entitled "WIRELESS ENERGY TRANSFER FOR REFRIGERATOR APPLICATION," U.S. Provisional Patent Application No. 61/530,495 filed on Sep. 2, 2011 and entitled "RESONATOR ENCLOSURE," U.S. patent application Ser. No. 13/603,002 published on Mar. 7, 2013 as U.S. Pat. Pub. No. 2013/0057364 and entitled "RESONATOR ENCLOSURE," U.S. patent application Ser. No. 12/770,137 published on Nov. 4, 2010 as U.S. Pat. Pub. No. 2010/0277121 and entitled "WIRELESS ENERGY TRANSFER BETWEEN A SOURCE AND A DEVICE," U.S. patent application Ser. No. 12/899,281 published Mar. 31, 2011 as U.S. Pat. Pub. No. 2011/0074346 and entitled "VEHICLE CHARGER SAFETY SYSTEM AND METHOD," U.S. patent application Ser. No. 13/536,435 published on Dec. 13, 2012 as U.S. Pat. Pub. No. 2012/0313742 and entitled "COMPACT RESONATORS FOR WIRELESS ENERGY TRANSFER IN VEHICLE," U.S. patent application Ser. No. 13/608,956 published on Mar. 21, 2013 as U.S. Pat. Pub. No. 2013/0069441 and entitled "FOREIGN OBJECT DETECTION IN WIRELESS ENERGY TRANSFER SYSTEMS," U.S. patent application Ser. No. 13/612,494 published Mar. 14, 2013 as U.S. Pat. Pub. No. 2013/0062966 and entitled "RECONFIGURABLE CONTROL ARCHITECTURES AND ALGORITHMS FOR ELECTRIC VEHICLE WIRELESS ENERGY TRANSFER SYSTEMS," and U.S. patent application Ser. No. 13/275,127 published May 17, 2012 as U.S. Pat. Pub. No. 2012/0119569 and entitled "MULTI-RESONATOR WIRELESS ENERGY TRANSFER INSIDE VEHICLES," the contents of which are incorporated in their entirety as if fully set forth herein.

One challenge in wireless energy transfer systems is robust and practical packaging or enclosures of resonators, coils, and other wireless energy transfer components. Proper packaging of resonators and coils is crucial for resonators and coils in vehicle and high power applications. Enclosures need to manage thermal loads and provide proper cooling for internal components, provide enough mechanical stability to prevent changes in parameters of coils, add minimal size to the overall size of the coil, provide weather resistance, and the like. Accomplishing all these requirements in a small package with minimal z-height of the enclosure is extremely challenging.

Therefore a need exists for methods and designs for coil and resonator enclosures with that add minimal size to the overall size while providing the necessary thermal, structural, and environmental capabilities.

SUMMARY

Wireless energy transfer using non-radiative techniques may involve the use of magnetic resonator structures as the energy transfer elements. These resonator structures may be adapted to generate an oscillating magnetic field that may be used as the medium of wireless energy transfer. A magnetic resonator structure may comprise one or more inductive elements having an inductance and one or more capacitive elements having a capacitance. The size and shape of the resonator structures may be determined by the amount of power to be transferred and the application for which it is designed. A wireless energy transfer system may require the use of two or more magnetic resonators. In embodiments, magnetic resonator structures may be referred to as a source and/or device and/or repeater wherein a source resonator or resonators may couple with a device resonator or resonators to generally deliver power to a load. Successful wireless energy transfer may also require the use of electronics for the conversion of electrical energy, tuning between resonators, etc. Additionally, magnetic material may be used as a guide for the magnetic field, a shield from lossy materials, etc. In some embodiments, the one or more resonators may be wrapped around the magnetic material to optimize wireless energy transfer. Wireless energy transfer may be further optimized with the use of communication and control systems.

Resonator enclosures may need to hold some or all of the components needed for wireless energy transfer. An enclosure may be designed for optimal wireless energy transfer, mechanical stability, thermal management, aesthetics, or any combination thereof. In some embodiment, the energy and mechanical requirements of the application may be deciding factors in the design of the resonator enclosure.

DETAILED DESCRIPTION

Figure 1B:
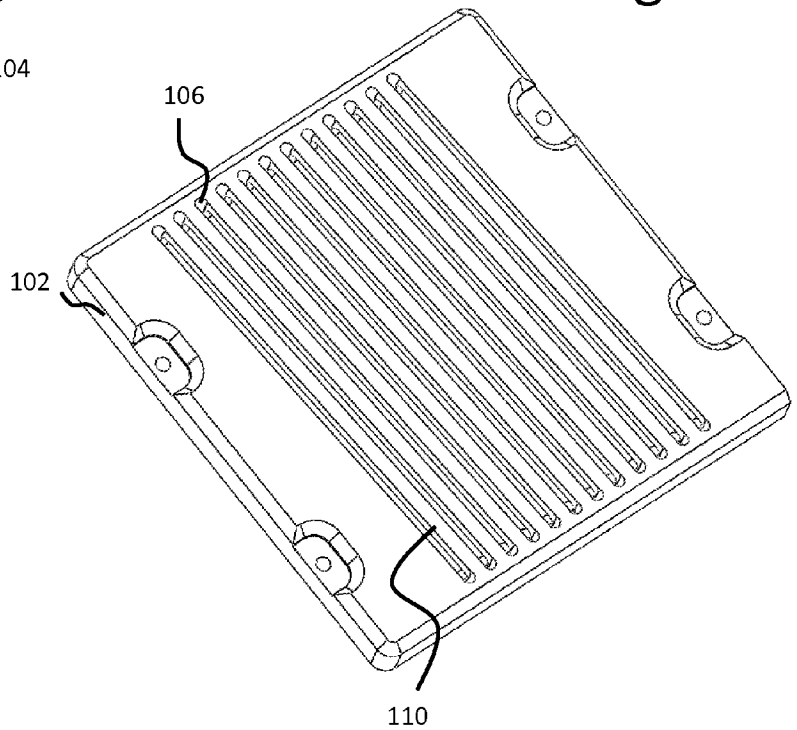
FIG. 1A and FIG. 1B are isometric views of an enclosure structure.

As described above, this disclosure relates to wireless energy transfer using coupled electromagnetic resonators. However, such energy transfer is not restricted to electromagnetic resonators, and the wireless energy transfer systems described herein are more general and may be implemented using a wide variety of resonators and resonant objects.

In vehicle applications, resonator enclosures may be necessary for the success of wireless energy transfer as well as the protection of the enclosed components. Resonator enclosures may be designed for mechanical stability and thermal regulation of the components such as one or more resonators, electronics, magnetic materials, etc. These design considerations may be balanced by requirements of the enclosure to be a certain size, shape, or weight. Furthermore, the overall design of the wireless energy transfer system may determine the designs for the individual resonator enclosures, such as the one or more source and device enclosures.

Resonator Enclosure

Resonator and coil structures may require enclosures for deployment, safety, testing, transport, and the like. Resonator and coil enclosures may be useful for providing electrical safety, protection from the environmental elements, structural rigidity, thermal regulation, and the like.

Resonator enclosures for vehicles and other high power applications may be designed to support system operation at high power levels and strenuous environmental conditions that may affect the resonators and electronics. In vehicle applications, the resonator enclosures may be mounted on the outside or under a vehicle or placed on or under the ground. Device resonators mounted on the outside or underside of a vehicle may be exposed to environmental elements such as rain, snow, various temperatures, debris, and the like. Similarly, source resonators mounted in parking lots, structures, garages, and the like may be exposed to environmental elements such as rain, snow, various temperatures, debris, and the like.

In embodiments, a resonator enclosure may comprise sensors for safety, testing, thermal regulation, service, maintenance, control, and the like. Sensors may include as thermal sensors, field sensors, water sensors, acoustic sensors, gas sensors, infrared sensors, cameras, foreign object detection sensors, and the like. Sensors may be integrated into the internal area of an enclosure, embedded in the outer cover or shell of the enclosure, and/or may be located outside of the enclosure by extension, separation, etc. In some embodiments, a foreign object detection sensor or set of sensors may be integrated or otherwise attached to the other surface of the enclosure. A foreign object detection sensor may be designed to sense objects, extraneous objects, lossy objects, conductive objects, animals, humans, organic objects, or any other object that is near, on, by, beside, under, or over a resonator enclosure. In some embodiments, sensors may be utilized on both the source and device-side resonator enclosures in a wireless energy transfer system.

Physical Characteristics

In embodiments, the size, shape, and weight of the resonator enclosure may be critical for successful integration in applications. For vehicles, as for many other applications, overall size, and shape of the packaged coils and resonators used for wireless energy transfer may be an important factor since the packaged resonators need to fit in a predefined area and may not decrease a vehicle's ground clearance. The size, shape, and weight of the resonator enclosure may be determined by the amount of power required for the application. For example, in the vehicle application, the resonator in the enclosure may be larger for higher power requirements. In some embodiments, the magnetic material used may be scaled in length, width, and/or height in order to keep magnetic field losses at a minimum. For example, larger resonators for greater power or gap requirements may require larger pieces of magnetic material which in turn may require larger enclosures.

In some embodiments, the size of the resonator enclosure may be designed for safety purposes. The enclosure may be enlarged beyond the volume needed for the enclosed parts. In some cases, this size enclosure may serve as a visual reminder or warning to a user to keep away from an area where the magnetic field is at its strongest. For example, the enclosure that holds the resonator, electronics, magnetic materials, etc. may be located at the center of a larger enclosure which may provide the visual reminder to the user. The larger enclosure may be made of the same material as the smaller enclosure. In some cases, the larger enclosure may resemble a mat that may be easy for a vehicle or other machinery to drive over.

In some embodiments, a large enclosure may be advantageous for thermal management, mechanical stability, cost-effectiveness, and the like in areas where a small enclosure is not necessary. For example, for wireless energy transfer systems housed in large warehouses or parking lots for storing vehicles such as utility vehicles or construction machinery, a large enclosure may be used instead of a small enclosure.

The size, shape, and weight of the resonator enclosure may be determined by the gap required between the source and device of the wireless energy transfer system. For example, in the vehicle application, the resonator in the enclosure may be larger for gaps of greater distance. Conversely, the resonator in the enclosure may be smaller for gaps of lesser distance.

In some embodiments, the shape of an enclosure may also be an important factor for an application. For example, the shape of the enclosure may ensure that the package does not interfere with other parts of a vehicle. The shape of the enclosure may be determined by the placement of the enclosure on the vehicle. For example, the enclosure may be especially shaped to be located on the front, front underside, middle underside, back underside, back of the vehicle, etc. If the enclosure is to be located in a front bumper of a vehicle, it may be shaped to fit inside of a bumper. If the enclosure is to be located under a vehicle, it may need to be as thin as possible to not decrease the ground clearance. The shape of the enclosure may be determined by the shape of the resonator and/or internal placement of the electronics. For example, the electronics may be placed to one side of the resonator or otherwise partitioned from the resonator. In some embodiments, the type and model of a vehicle may determine the shape of an enclosure.

In some embodiments, the weight of an enclosed resonator may also be important. In the example of the vehicle, the weight of the enclosure may determine where and how the enclosure can be fixed on the underbody of the vehicle. The weight of the enclosure may also determine how and the type of material used to mount the device enclosure on to the vehicle. For example, the enclosure may be mounted onto the underside of a vehicle where it will have the most support and stability. This may include specific parts of the vehicle such as the frame of the vehicle which could provide a stable and strong location for the mounting of an enclosure. In some embodiments, the weight of the enclosure may be greater to provide more stability to the enclosed parts, including the resonator, electronics, magnetic material, shielding, etc. For example, elements of the enclosure may be potted or encased in resin to ensure both mechanical and electrical stability. This may create a heavier overall enclosure but with an advantage of having greater stability.

Enclosure Placement

In embodiments, the source resonators may be placed on the ground and may also be subjected to harsh environments as well as high weight loads such as vehicles driving over a source. In a source enclosure design, it may be preferable to reduce the height of the overall resonator structure such that it does not pose a tripping hazard, obstruction to machinery such as plows or lawn mowers, and the like. It may also be preferable to reduce the height of the overall resonator enclosure to ensure that a vehicle has enough ground clearance. For example, vehicles such as sports cars may have lower ground clearance and may require a source enclosure with a low profile so as to not significantly compromise the fidelity of the wireless power transfer.

In embodiments, source resonator structures may be buried or placed below ground level. Buried source resonators may be preferable in outdoor locations where the surface above the source resonator may need to be cleaned, plowed, mowed, treated, and the like. Buried source resonators may also be preferable for vehicles or machinery with low ground clearance. In embodiments, a cavity may be formed on top of the ground or below the ground to house the source resonator and to facilitate the removal and replacement of source coil/resonators. Source resonators may need to be replaced if they stop working, or if newer designs or system upgrades are desired or required.

In embodiments, source resonators may be placed below ground level, in dirt, asphalt, tar, cement, pavement, and the like, and combinations thereof, in a wireless power transfer system. In embodiments, it may be preferable to place the source resonators in specially designed cavities to facilitate repair, replacement, and/or maintenance of the resonators. In embodiments, a below ground, or partially below ground cavity may be formed in the dirt, asphalt, tar, cement, pavement, and the like, and the cavity may be designed to provide certain environments for the source resonator structure.

In some embodiments, a source resonator may be placed or integrated into a parking structure or lot, which may include the ground, walls, columns, sidings, poles, and the like. The size, shape, weight, and material of the enclosure of a source resonator may be designed such that it may successfully integrate into a parking structure. For example, the weight of the enclosure may be important if the enclosure is to be fixed on a wall or column some distance off of the ground.

In embodiments, the cavity may be formed in the ground itself and/or it may comprise an insert made of plastic, PVC, Delryn, ABS, Ultem, Teflon, Nylon blends, magnetic materials, conducting materials, non-lossy materials, or any materials described in this disclosure, depending on the overall system design.

In embodiments, an insert may be formed of a non-lossy material when the source resonator is embedded in non-lossy materials such as dirt. In embodiments, the purpose of the insert may be purely structural, and the insert may be used to keep the cavity from collapsing around the source resonator.

In embodiments, the insert may be formed of highly-conducting materials when the source resonator is to be embedded in a lossy environment, such as in cement surface comprising steel bars or rebar. In embodiments, the insert may provide shielding or field shaping functionality to the source resonator.

In embodiments, the insert may facilitate conditioning of the environment around the source resonator. For example, the insert may be designed to allow water to drain out of the cavity, or to allow nitrogen or other gases to be pumped into the cavity. In embodiments, the insert may be designed to allow probes or cameras to be inserted in the cavity to test the status of the source resonator and/or the cavity itself.

In embodiments, the insert may comprise sensors, such as thermal sensors, field sensors, water sensors, acoustic sensors, gas sensors, cameras, and the like, for use in diagnostic and maintenance activities. In embodiments, such sensors may be part of the system operation and be part of sensing and control systems that are used in the wireless power transfer system.

In embodiments, the cavity may be designed with a lid that may be removed to access the source resonator structure. In some embodiments, the lid may be designed so that it may be removed for maintenance and/or by maintenance professionals.

In embodiments, the cavity may be elongated to accommodate multiple resonators and/or repeater resonators. In embodiments, the cavity may run underneath driving surfaces and the source resonators may be configured to provide power to the device resonators and/or repeater resonators as they move over the sources in the cavities.

In embodiments, the cavity may serve as a temporary cover for a source enclosure. In some embodiments, a cover over the cavity may be automated or controlled via an external control. In such a case, a source enclosure may be exposed and ready for operation when the cover is removed. In a further embodiment, the level at which a source enclosure relative to the ground or device enclosure may be automated or controlled. For example, a user of the system may be able to control the opening and closing of a cover as well as the height at which the source rests before, during, and after wireless energy transfer may occur between the source and device.

Mechanical and Thermal Stability

In addition to these requirements, resonator enclosures may need to manage thermal loads and provide proper cooling for internal components and/or to properly cool the temperature on the surface of the enclosure. The enclosures may need to provide enough mechanical stability to prevent changes in the electrical parameters of resonators and to protect brittle magnetic material that may be part of some resonator structures. The enclosures may need to be mechanically stable with minimal or no use of structural metals, which may load and reduce the quality factor of the coil or resonator in the final assembly.

The inventors have designed an effective structure for holding and securing the components of a resonator while providing adequate structural integrity, thermal control, protection against environmental elements, and the like. The structure adds minimal size to the overall resonator assembly allowing the structure to be mounted on or under a vehicle and on or under the ground.

For further mechanical stability, the materials chosen for the enclosure may have trade-offs in its elasticity characteristics. In some embodiments, enclosure materials may be chosen to be more rigid than flexible to prevent damage to the enclosed parts, such as the electronics. In other embodiments, enclosure materials may be more flexible than rigid to prevent damage by absorbing impact. For example, to protect brittle yet heavy magnetic material used in a vehicle's device resonator enclosure, the enclosure material may need to be rigid enough to prevent bending, warping, or otherwise deforming. This may especially be important when the vehicle is in motion or exposed to harsh conditions.

In some embodiments, it may be necessary to mechanically isolate magnetic material in the enclosure. This may mean having to encase the magnetic material in supplemental materials and/or with supplemental methods. Methods may include fixing the magnetic material at its weakest areas or potting the magnetic material in resins such as polycarbonate or filled polymer. In some embodiments, it may be advantageous to use a thermally conductive plastic that does not have lossy electro-magnetic properties. For example, plastics filled with carbon or metals may induce losses in the electromagnetic field of the wireless power transfer system and these properties may be considered before using such materials in a resonator enclosure.

EXAMPLE EMBODIMENTS

Figure 1A:
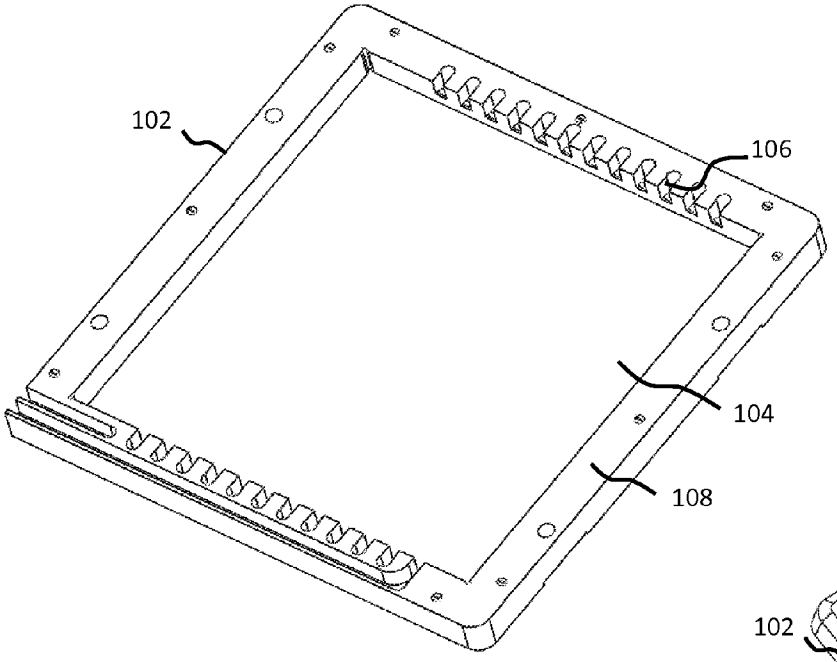

In an exemplary embodiment, a resonator enclosure structure comprises a flat, planar plate with a pocket for tiling blocks of magnetic material and a series of channels and holes for wrapping an electrical conductor around the blocks of magnetic material. The main features of the structure are described using an example embodiment. An example structure is shown in FIG. 1A and FIG. 1B. FIG. 1A shows the bottom side and FIG. 1B shows the top side of the enclosure structure. The main structure comprises a flat planar plate 102 with a recessed pocket 104 and a series of holes 106 and channels 110. The main structure may be machined, cast, injected molded, and the like out of, preferably, a non-lossy material such as plastic or a composite. Materials such as ABS, Nylon blends, Ultem, Delryn, and the like may be suitable. Those skilled in the art will appreciate that each material type has different mechanical and thermal properties which may make specific materials more suitable for different environments. The planar plate may comprise of a single solid piece of material or it may comprise two or more pieces that may be bonded, glued, screwed or attached together to form the overall structure.

Figure 2:
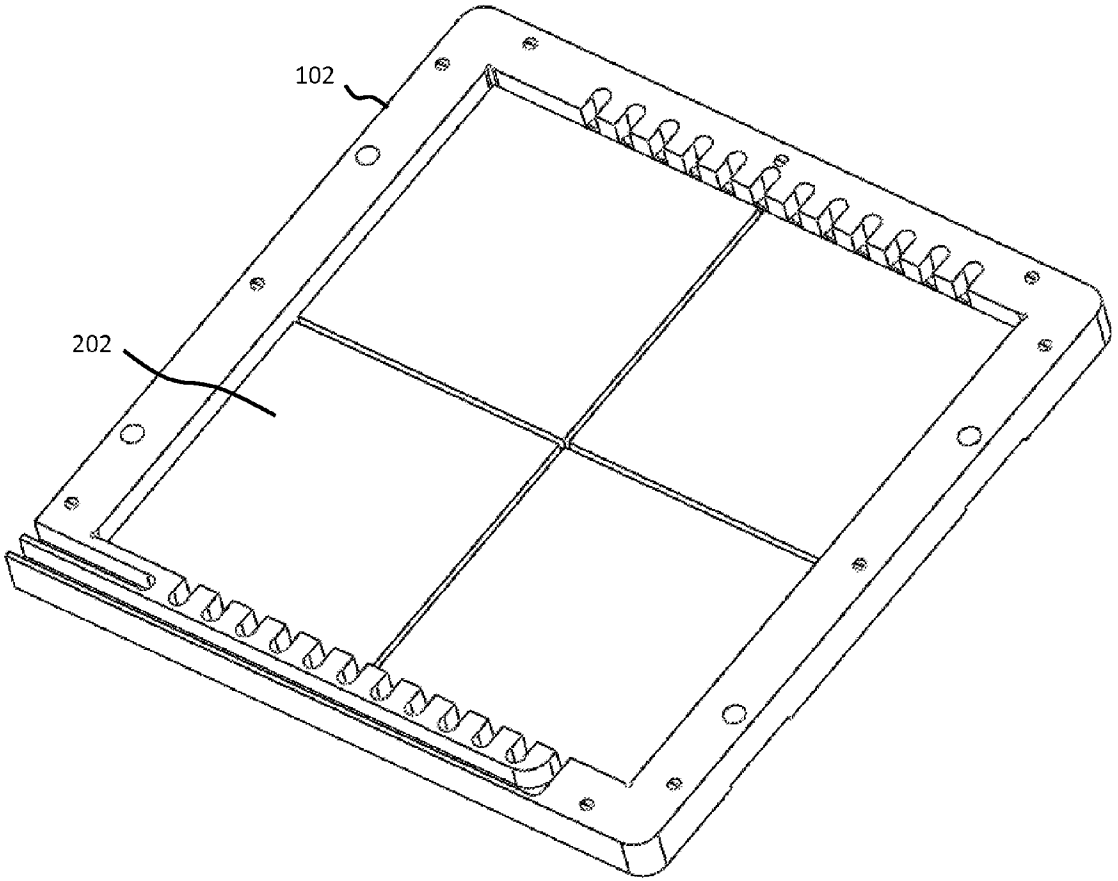
FIG. 2 is an isometric view of an enclosure structure with magnetic material.

The recessed pocket 104 may be shaped and cut to a depth to house one or more blocks of magnetic material. FIG. 2 shows the structure 102 with four rectangular blocks of magnetic material 202. The pocket may be shaped to accommodate various dimensions and sizes of blocks. In the structure, the one or more blocks of magnetic material 202 may be assembles, placed, fitted, glued, potted, adhered, or attached together and/or to the structure 102 with other means.

Figure 3:
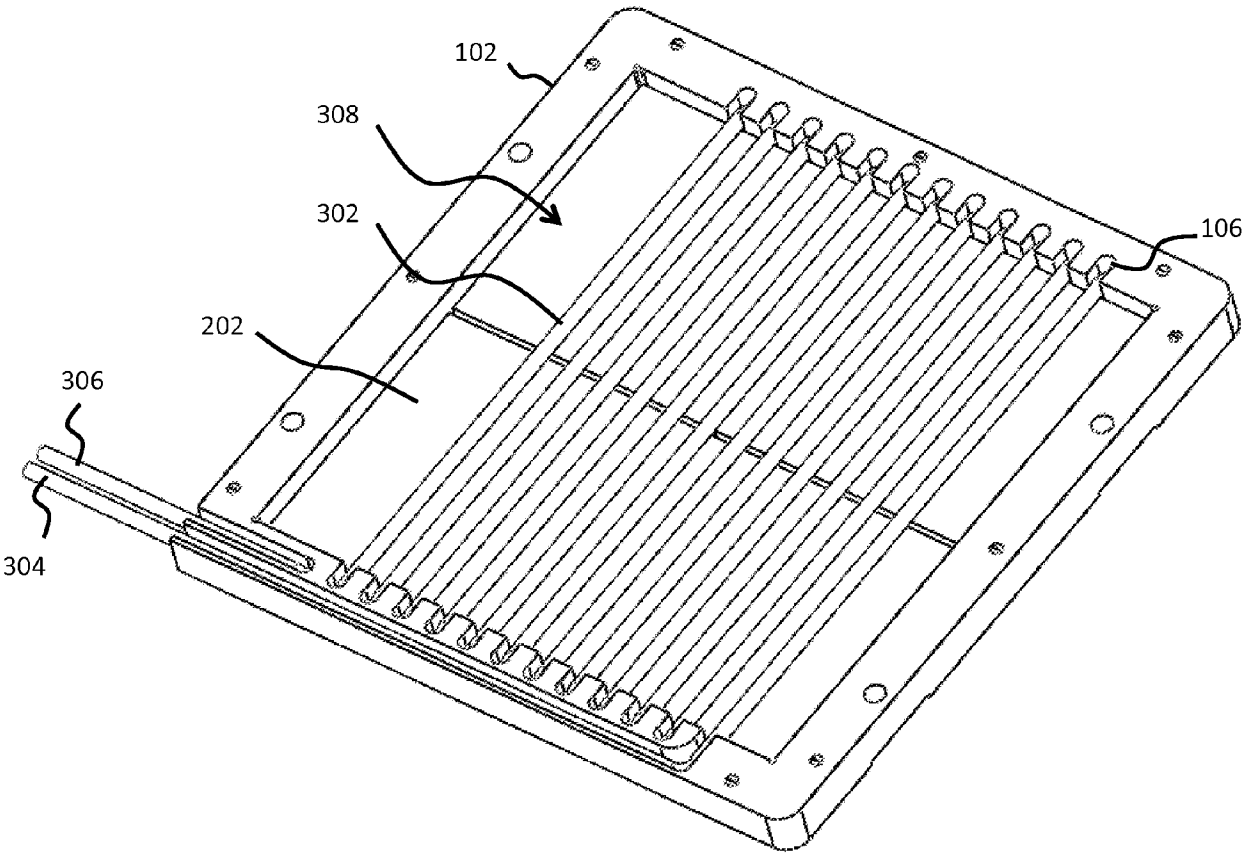
FIG. 3 is an isometric view of an enclosure structure with magnetic material and wrapped with wire.

The series of holes 106 and channels 110 may be sized and shaped to house a conductor wire that wraps around the structure through the holes and around the blocks of magnetic material forming loops. An exemplary structure with a wrapped wire is shown in FIG. 3. The wire 302 wraps around the structure, passing through the holes 106 and fitting into the grooves on the top side (not shown) of the structure. The wire 302 wraps around the blocks of magnetic material 202 forming one or more loops. The ends of the wire 304, 306 may lead out of the structure and connect to other electronics or components. In embodiments a layer of electrical insulator may be placed between the wire and the blocks of magnetic material. In other embodiments, some electronic components or other components may also be housed in the recessed pocket of the structure.

The pocket area of the structure 308 that houses the blocks of magnetic material 202 and the wire 302, and optionally other components, may be potted and/or filled with epoxy to stabilize the components, may provide a good thermal pathway to the top of the structure and/or may provide structural stability in case of vertical loads.

Figure 4A:
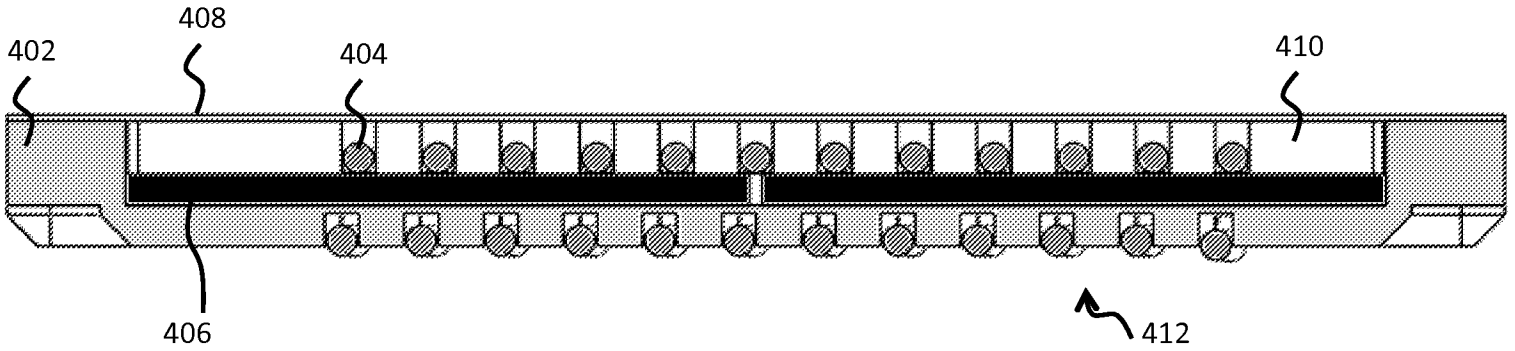
FIG. 4A and FIG. 4B are cross section views of the enclosure structure with the wire, magnetic material, and optional cover.

A cross sectional view of the structure with the wire and magnetic material is shown in FIG. 4A. The figure shows a cross section of the structure that is parallel to the axis of the loops formed by the wire when wrapped around the structure. The cross section shows the structure 402 with the magnetic material 406 inside the pocket area 410 of the structure and the cross section of the wire 404 that wraps around the structure and the magnetic material.

Figure 4B:
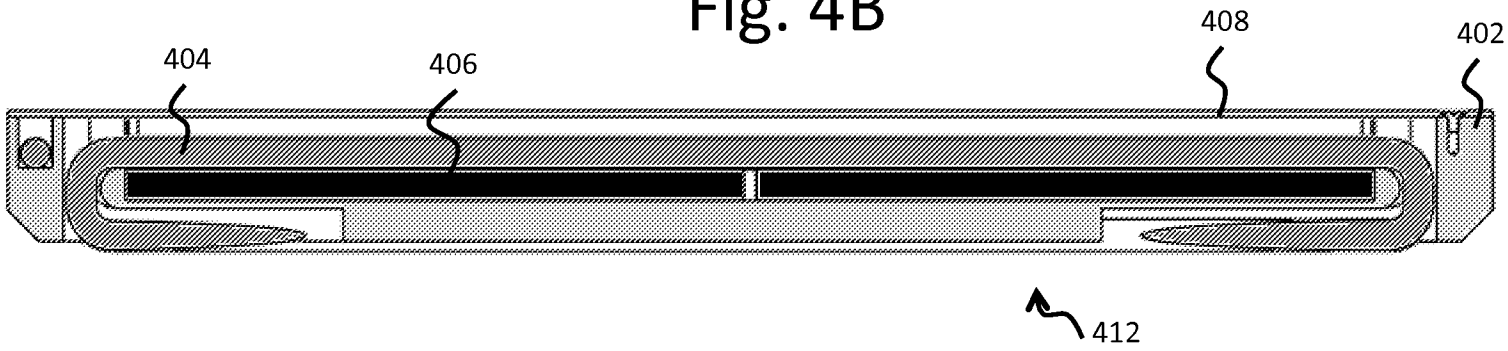

Another cross sectional view of the structure that is perpendicular to the axis of the loops formed by the wire is shown in FIG. 4B. The cross section shows the structure 402 with the magnetic material 406 and the wire 404 that wraps around the structure and the magnetic material.

FIGS. 4A and 4B show an optional cover 408 on the bottom side of the structure. The cover may comprise a good electrical conductor such as copper or aluminum. In an embodiment, the conductor may provide some shielding and some heat transfer functionality. The cover may also preferably comprise a good thermal conductor and may be glued or thermally connected to the potting or epoxy that fills the pocket 410 of the structure to provide a good thermal path. In applications the cover 408 may be attached to a larger thermal mass or a heat sick to dissipate the heat away from the internal components of the structure. In embodiments, the cover may make good thermal contact with a vehicle. For example, thermal grease, tape, foam, and the like may be used between the cover and the attachment surface of the vehicle. In some embodiments, external cooling by fans, cooling pipes, thermal electric coolers (TECs), heat sink fins, and the like may be used to cool the cover of the resonator structure.

In embodiments an optional cover (not shown) may also be positioned on the top side of the structure 412 to cover the wires and provide for an additional protection against impact from debris. Optionally the channels on the top side of the structure that house the wires may also be potted or epoxied completely hiding and encapsulating the wire inside the structure.

In embodiments the structure may include an additional pocket or section for additional electronics or electrical components such as capacitor, inductors, and the like. The electronic components may be thermally in contact with the outer enclosure cover as a path for heat to escape. In some embodiments, electronic components may be positioned or protected based on their type. For example, a thermal interface material may be used between the top of a capacitor or group of capacitors and the conductive material to provide a heat sink.

In an exemplary embodiment, a 25 cm by 25 cm with a 2 cm height structure was sufficient to enclose a 20 cm by 20 cm coil structure capable of receiving 3.3 kW of power in a wireless power transfer system. The structure was able to dissipate more than 75 Watts of power during operation with a 30° C. temperature rise. The total weight of the structure with wire and magnetic material was about 3 kg. The structure material was Ultem. The size of the structure may be scaled or enlarged to dissipate more heat and reduce the temperature rise of the resonator structure when the system is operating. The dimensions and material selection may be adapted to better match the required properties for larger or smaller dimensioned structures. The dimensions and material selection may also be adapted for wireless energy systems of varying power levels, such as greater than 1 W, greater than 3 W, or greater than 6 W.

Figure 5:
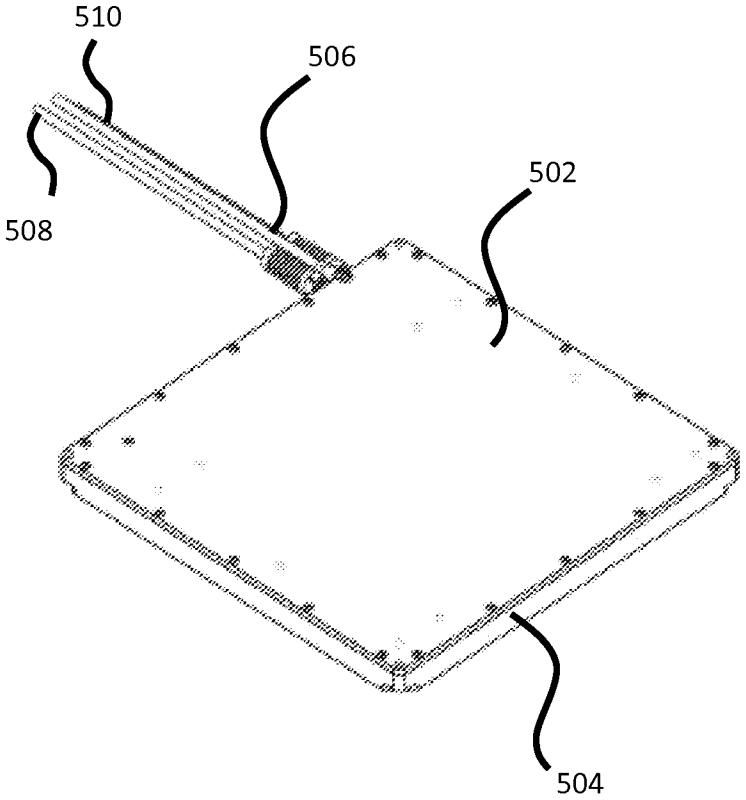
FIG. 5 is an isometric view of a resonator enclosure.

In another exemplary embodiment, a 30 cm by 25 cm by 2 cm is sufficient to enclose a coil structure capable of receiving 3.3 kW of power in a wireless power transfer system. FIG. 5 shows an embodiment of the outer mechanical enclosure for a resonator in a wireless energy transfer system. The top of the enclosure 502 may be made of aluminum or another good conductor that will aid in dispersing heat from the internal parts of the enclosure. The top of the enclosure may be grounded via a ground wire 506. The bottom of the enclosure 504 may be made of a plastic such as Ultem that may be primarily chosen to ensure rigidity in the structure. Plastics may also ensure that the overall structure is lightweight if installed on a vehicle, on a wall, column, or anywhere that requires mounting away from the ground. Leading into the outer enclosure are two cables or wires 508, 510 for the input and output from the resonator enclosure. In some embodiments, there may be one or multiple cables to provide the input and/or output leading from the enclosure.

The outer structure parts may be sealed with a gasket. A gasket may be made of thermoplastic elastomer, rubber, or other non-lossy material that can withstand high temperatures. A shield between the resonator and electronics may be used. In embodiments, the shield may be made of a material that has good electrical and thermal conductivity, such as copper. In some embodiments, a copper shield may be in thermal contact with the electronics and an exemplary aluminum cover. A copper shield may provide a heat path from the electronics to a cover and may also be used as a heat sink of the resonator. In embodiments, the copper shield may be a continuous piece of copper, soldered together from smaller pieces of copper, and the like. A magnetic material may be used as a shield between the resonator and the metallic underbody of the vehicle. The magnetic material may prevent losses due to the metallic parts and may also be used to guide the magnetic field of the resonator.

Figure 6A:
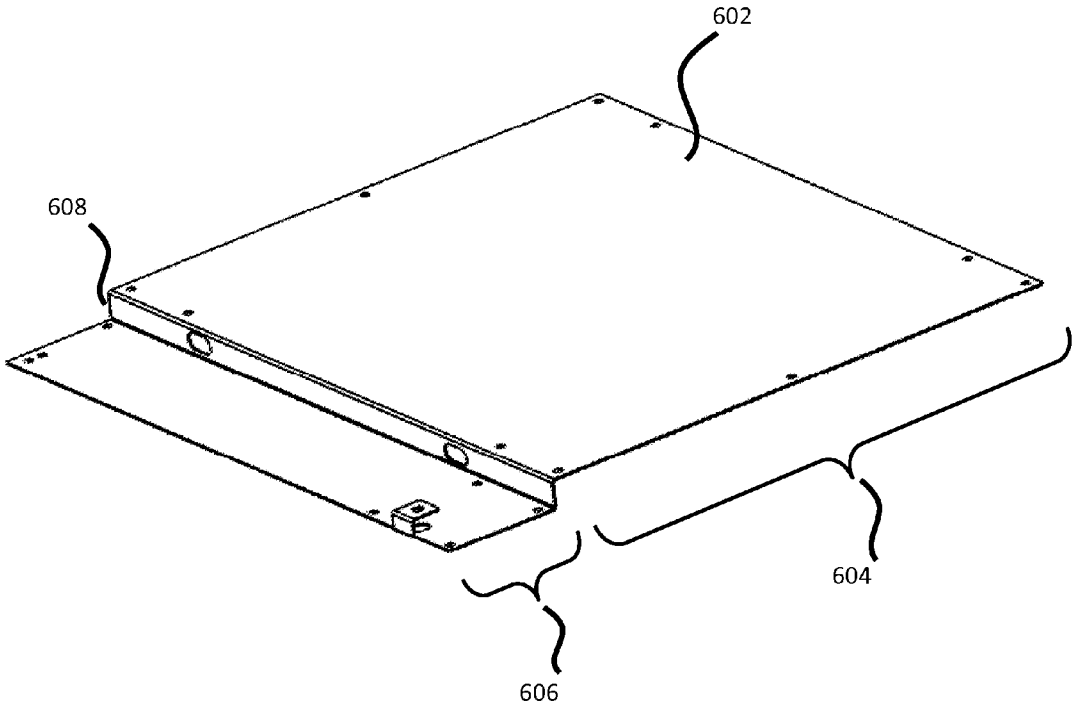
FIG. 6A is an isometric view of a copper shield inside a resonator enclosure and FIG. 6B is a cross-sectional view of a representation of the resonator enclosure.
Figure 6B:
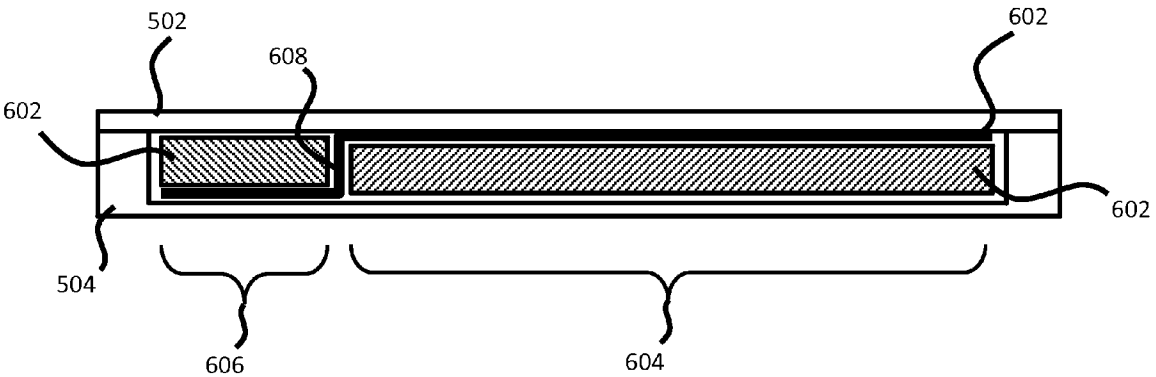

In some embodiments, a copper plate may be used to shield the electronics from the resonator in the enclosure. A copper shield is shown in one exemplary embodiment in FIG. 6A. The copper shield 602 is shaped to accommodate the difference in volume of the area that holds the electronics 606 and the area that holds the resonator 604. The continuous piece of copper shield is stepped to create a barrier 608 between the electronics and resonator. A copper shield may also be used for thermal management. In some embodiments, a copper shield may be used to create a path for the heat from the electronics and/or the resonator to dissipate to the outer surface of the enclosure. Additional materials may be used with copper to create a path for heat to escape, such as thermal interface material (TIM). TIM may be used to ensure a good thermally conductive connection between the copper shield and the outer cover of the resonator enclosure. Some parts of the enclosure may need to be insulated from the copper shield. In such a case, a thermal insulator such as a plastic may be used to create this barrier.

Figure 7A:
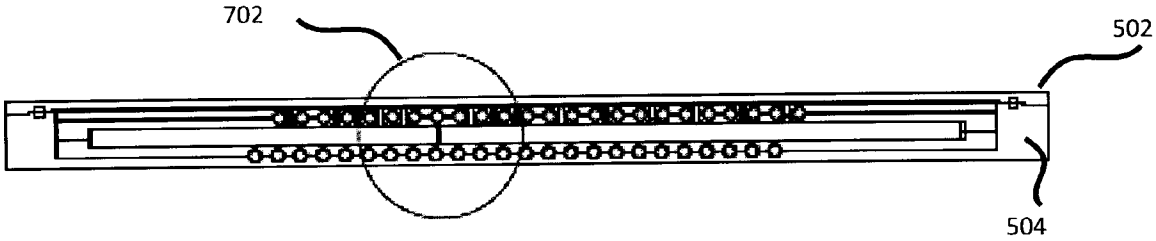
FIG. 7A is a cross-sectional view of a resonator enclosure with an encircled close-up view shown in FIG. 7B
Figure 7B:
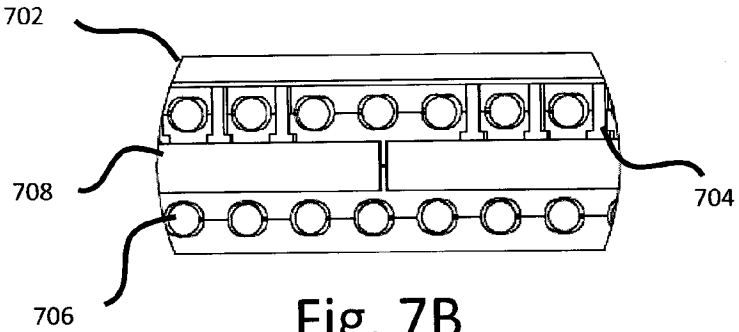
FIG. 7C is an isometric view of a bar made of conductive material.
Figure 7C:
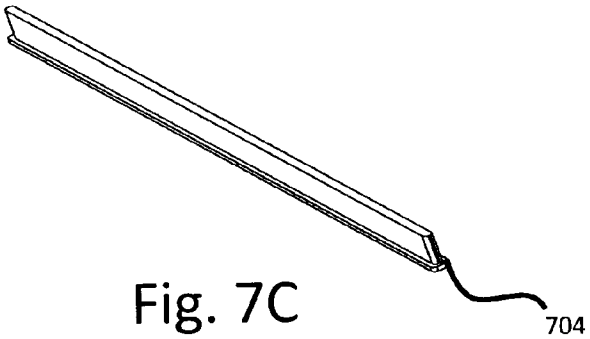

In some embodiments, other materials may be used to provide a path for heat to escape to the outer surface of the resonator enclosure. For example, heat may build up in the magnetic material that forms the core of the resonator coil. As heat builds up in the magnetic material, it may not be able to dissipate heat efficiently. The inventors have designed an enclosure part such that more paths are created to dissipate heat. FIG. 7 shows an exemplary embodiment of the invention. FIG. 7A and sub-view FIG. 7B show a cross section 702 of a resonator enclosure, which has an outer cover of aluminum 502 and Ultem 504. To create the path for heat to dissipate from the magnetic material to outer cover, T-shaped bars of conductive material, such as aluminum, are placed between the magnetic material 708 and the outer cover (also made of aluminum) 502. Furthermore, the bars of aluminum 704 are designed and shaped such that they do not come in contact with the conducting loops of the resonator coils 706. This allows only the heat from the magnetic material to be transferred to the bars of aluminum which is then transferred to the outer cover of the resonator enclosure.

Figure 8B:
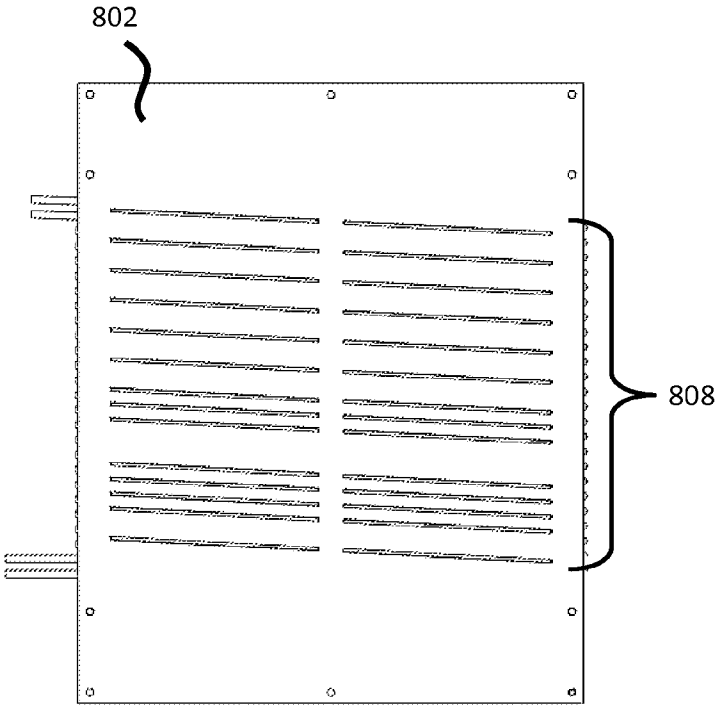
FIG. 8A and FIG. 8B are isometric and top views of the inside of a resonator enclosure showing a pattern of bars made of conductive material.
Figure 8A:
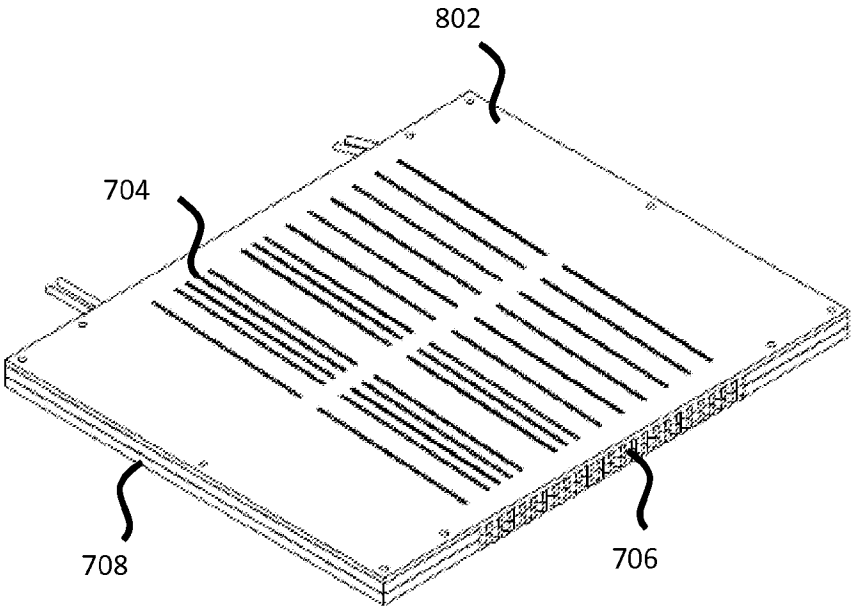

In a further embodiment, the bars of conductive material may be placed in an optimal pattern for efficient heat transfer from the magnetic material to the outer surface of the resonator enclosure with minimal impact on the electromagnetic properties of the resonator itself. FIG. 8 shows an exemplary embodiment of such a pattern. FIG. 8A shows an internal view of an exemplary resonator enclosure where a resonator conductor 706 is wrapped around magnetic material 708. A top view 802 is provided in FIGS. 8A and 8B to show the pattern of the bars 704. The pattern 808 illustrates that the areas where the bars may be needed the most may not be linear with respect to the resonator or to the magnetic material. The pattern may be optimized empirically or through experimentation with a resonator design and/or resonator enclosure design.

While the invention has been described in connection with certain preferred embodiments, other embodiments will be understood by one of ordinary skill in the art and are intended to fall within the scope of this disclosure, which is to be interpreted in the broadest sense allowable by law.

All documents referenced herein are hereby incorporated by reference in their entirety as if fully set forth herein.

We claim:

1. A resonator enclosure for wireless energy transfer comprising:

a first generally rectangular planar material having a top and a bottom side wherein a recess is fabricated into the top side;

a first section of the recess containing a magnetic resonator comprising a conductor having one or more turns and wrapped around one or more pieces of magnetic material;

a second section of the recess containing electronic components;

a sheet of conductive material forming a barrier between the first section of the recess containing the magnetic resonator and the second section of the recess containing the electronic components; and a second generally rectangular planar material forming a cover to the recess fabricated into the first generally rectangular planar material, wherein the sheet of conductive material is in thermal contact with the second generally rectangular planar material via a thermal interface material.

2. The enclosure of claim 1, wherein the first generally rectangular planar material is made of a non-lossy material.

3. The enclosure of claim 1, wherein the first section of the recess comprises a plurality of parallel grooves to hold the conductor wrapped around the one or more pieces of magnetic material.

4. The enclosure of claim 1, wherein the sheet of conductive material is copper.

5. The enclosure of claim 1, wherein the sheet of conductive material is in thermal contact with the electronic components and thermally isolated from the magnetic resonator.

6. The enclosure of claim 1, wherein the sheet of conductive material is in electrical contact with the electronic components and electrically isolated from the magnetic resonator.

7. The enclosure of claim 1, wherein the second generally rectangular planar material is made of a conductive material.

8. The enclosure of claim 7, wherein the second generally rectangular planar material is aluminum.

9. The enclosure of claim 1, further comprising conductive material placed in thermal contact between the one or more pieces of magnetic material and the sheet of conductive material forming the barrier between the first section of the recess and the second section of the recess.

10. The enclosure of claim 9, wherein the conductive material is placed in between the one or more turns of the conductor without thermally contacting the one or more turns of the conductor.

11. The enclosure of claim 9, wherein the conductive material is placed to provide an efficient path for heat to travel from the one or more pieces of magnetic material to the second generally rectangular planar material.

12. The enclosure of claim 1, wherein the second generally rectangular planar material can be separated from the first generally rectangular planar material for service.

13. The enclosure of claim 1, wherein the first and second generally rectangular planar materials are joined via a gasket made of non-lossy material.

14. A resonator enclosure for wireless energy transfer comprising:

a first generally rectangular planar material having a top and a bottom side wherein a recess is fabricated into the top side;

a first section of the recess containing a magnetic resonator comprising a conductor having one or more turns and wrapped around one or more pieces of magnetic material;

a second section of the recess containing electronic components;

a sheet of conductive material forming a barrier between the first section of the recess containing the magnetic resonator and the second section of the recess containing the electronic components;

a second generally rectangular planar material forming a cover to the recess fabricated into the first generally rectangular planar material; and a second conductive material placed in thermal contact between the one or more pieces of magnetic material and the sheet of conductive material forming the barrier between the first and second sections of the recess, wherein the second conductive material is placed in between the one or more turns of the conductor without thermally contacting the one or more turns of the conductor.

15. The enclosure of claim 14, wherein the conductive material is placed to provide an efficient path for heat to travel from the one or more pieces of magnetic material to the second generally rectangular planar material.

16. The enclosure of claim 14, wherein the second generally rectangular planar material can be separated from the first generally rectangular planar material for service.

17. The enclosure of claim 14, wherein the first and second generally rectangular planar materials are joined via a gasket made of non-lossy material.

18. The enclosure of claim 14, wherein the first section of the recess comprises a plurality of parallel grooves to hold the conductor wrapped around the one or more pieces of magnetic material.

19. The enclosure of claim 14, wherein the sheet of conductive material is in thermal contact with the electronic components and thermally isolated from the magnetic resonator.

20. The enclosure of claim 14, wherein the sheet of conductive material is in electrical contact with the electronic components and electrically isolated from the magnetic resonator.

* * * * *